US011308734B2

(12) United States Patent
Yohalashet

(10) Patent No.: US 11,308,734 B2
(45) Date of Patent: Apr. 19, 2022

(54) MOBILE DEVICE AND NAVIGATION DEVICE TOLL PAYING SYSTEM AND METHOD

(71) Applicant: Paytollo, Inc., Campbell, CA (US)

(72) Inventor: Abinezar Yohalashet, Campbell, CA (US)

(73) Assignee: Paytollo, Inc., Campbell, CA (US)

( * ) Notice: Subject to any disclaimer, the term of this patent is extended or adjusted under 35 U.S.C. 154(b) by 959 days.

(21) Appl. No.: 14/963,338

(22) Filed: Dec. 9, 2015

(65) Prior Publication Data

US 2016/0171787 A1 Jun. 16, 2016

Related U.S. Application Data

(60) Provisional application No. 62/091,352, filed on Dec. 12, 2014.

(51) Int. Cl.
*G07B 15/06* (2011.01)
*G06Q 50/30* (2012.01)

(52) U.S. Cl.
CPC ..... *G07B 15/063* (2013.01); *G06Q 50/30* (2013.01)

(58) Field of Classification Search
CPC ..... G06Q 30/0284; G06Q 2230/00; G06Q 50/30; G07B 15/063; G01C 21/3415;
(Continued)

(56) References Cited

U.S. PATENT DOCUMENTS 4,546,241 A 10/1985 Walton
5,490,079 A 2/1996 Sharpe et al.
(Continued)

FOREIGN PATENT DOCUMENTS

CA 2850250 A1 9/2012
CN 111127680 A * 5/2020
(Continued)

OTHER PUBLICATIONS

"How to Create and Manage Geofences," by SimPRO Learning, https://helpguide.simprogroup.com/Content/simTRAC/Add-New-Geofences.htm, Oct. 13, 2020 (Year: 2020).*
(Continued)

*Primary Examiner* — George Chen
*Assistant Examiner* — Brian Adams Heflin
(74) *Attorney, Agent, or Firm* — Kramer Levin Naftalis & Frankel LLP

(57) ABSTRACT

A computer system processes the electronic payment of tolls by storing, on a toll collection server, an accounting record for a mobile user account that is associated with a mobile user and a mobile computing device. A database having a plurality of toll locations and at least one toll that is incurred by the mobile user when the mobile computing device passes the toll location is stored on a toll collection server. An electronic communication containing a notification that the mobile computing device passed the toll location is received. The accounting record is modified on the toll collection server to deduct the amount of the toll from the mobile user account. The toll collection server is coupled to a toll authority server. An electronic payment is sent to the toll authority server in an amount that is associated with the toll.

20 Claims, 10 Drawing Sheets

(58) Field of Classification Search
CPC ..... G01C 21/3626; G01C 21/367; G01C 21/3667; G01C 21/3676; H04N 5/2256; H04N 5/23206; H04M 1/0264; H04M 1/7253; H04M 1/725; H03J 3/04
See application file for complete search history.

(56) References Cited

U.S. PATENT DOCUMENTS 5,528,248 A 6/1996 Steiner et al.
5,721,678 A 2/1998 Widl
5,815,814 A 9/1998 Dennison et al.
5,857,152 A 1/1999 Everett
5,991,749 A 11/1999 Morrill, Jr.
6,477,362 B1 11/2002 Raith et al.
6,477,379 B2 11/2002 Kingdon
7,003,493 B2 * 2/2006 Weichert ..... G06Q 20/00 235/379
7,215,255 B2 5/2007 Grush
7,254,382 B2 8/2007 Hasan et al.
7,255,264 B2 8/2007 De Leon
7,397,424 B2 7/2008 Houri
7,676,392 B2 3/2010 Hedley et al.
7,774,228 B2 8/2010 Robinson et al.
7,970,644 B2 6/2011 Hedley et al.
8,265,988 B2 9/2012 Hedley et al.
8,363,899 B2 1/2013 Balachandran
8,463,642 B2 6/2013 Hedley et al.
8,473,332 B2 6/2013 Robinson et al.
8,504,415 B2 8/2013 Hedley
8,548,845 B2 10/2013 Hedley et al.
8,587,454 B1 11/2013 Dearworth
8,634,804 B2 * 1/2014 McNamara ..... G06Q 20/14 455/406
8,660,890 B2 2/2014 Hedley
8,768,755 B2 7/2014 Hedley et al.
8,775,235 B2 7/2014 Hedley et al.
8,775,236 B2 7/2014 Hedley et al.
8,996,289 B2 * 3/2015 Schenken ..... G07C 5/0866 701/120
9,071,453 B2 6/2015 Shoemaker et al.
9,077,770 B2 7/2015 Redpath
9,078,122 B2 7/2015 Miller
9,240,078 B2 1/2016 Hedley et al.
9,665,991 B2 5/2017 Simanek et al.
9,691,061 B2 6/2017 Deitiker et al.
2003/0067396 A1 4/2003 Hassett
2003/0161922 A1 8/2003 Hillmann
2005/0159133 A1 7/2005 Hasan et al.
2005/0197976 A1 9/2005 Tuton et al.
2006/0219781 A1 10/2006 Willgert
2006/0258367 A1 11/2006 Chiang
2007/0208666 A1 9/2007 He et al.
2007/0285280 A1 * 12/2007 Robinson ..... G07B 15/063 340/928
2008/0040210 A1 2/2008 Hedley
2010/0287037 A1 11/2010 Rice et al.
2011/0047009 A1 * 2/2011 Deitiker ..... G07B 15/063 705/13
2011/0087499 A1 4/2011 Menon et al.
2011/0136429 A1 6/2011 Ames et al.
2011/0208568 A1 8/2011 Deitiker et al.
2012/0329433 A1 12/2012 Fogarty
2013/0006724 A1 1/2013 Simanek et al.
2013/0006725 A1 * 1/2013 Simanek ..... G07B 15/063 705/13
2014/0015939 A1 1/2014 Mount et al.
2014/0025444 A1 * 1/2014 Willis ..... G06Q 20/3272 705/13
2014/0085110 A1 * 3/2014 Scofield ..... G07B 15/04 340/932.2
2014/0171013 A1 * 6/2014 Varoglu ..... H04W 4/90 455/404.2
2014/0188579 A1 * 7/2014 Regan, III ..... G07B 15/06 705/13
2014/0349672 A1 * 11/2014 Kern, Jr. ..... H04W 4/021 455/456.1
2014/0370909 A1 * 12/2014 Natucci, Jr. ..... H04W 52/0251 455/456.1
2016/0055466 A1 * 2/2016 Du ..... G06Q 20/145 705/13
2017/0057411 A1 * 3/2017 Heath ..... B60W 50/0097
2017/0185992 A1 * 6/2017 Campanaro ..... H04W 4/021

FOREIGN PATENT DOCUMENTS

DE 10200803253 A1 1/2010
EP 1338849 A1 8/2003
EP 2662632 A1 11/2013
WO 0111571 A1 2/2001
WO 2009043691 A1 4/2009
WO 2013190566 A1 2/2013
WO 2013020580 A2 12/2013
WO 201319053566 A2 12/2013
WO 201319053566 A3 12/2013
WO 2014018485 A1 1/2014
WO 2014085617 A1 5/2014
WO 2014085617 A1 6/2014
WO WO-2014116147 A1 * 7/2014 ..... G07B 15/063
WO WO-2017063052 A1 * 4/2017 ..... G06Q 20/145

OTHER PUBLICATIONS

"Geofencing: Increasing User Engagement & Enhancing User Experience," by Rajitha, Krify, Dec. 23, 2015 (Year: 2015).*
"What is meant by GeoFencing?" by Transics WABCO Company, Aug. 26, 2016 (Year: 2016).*
Official Action dated Feb. 9, 2018, issued in corresponding European Patent Application No. EP 15 19 7963.
Google English language version of DE10200803253.
Google English language version of EP2662632.
European Search Report dated Apr. 22, 2016, issued in corresponding European Patent Application No. EP 15 19 7963.
Accenture, Transforming Tolling through Innovation, IBTTA, 82nd Annual Meeting & Exhibition, Austin, TX, Sep. 2014.
Response to Official Action dated Feb. 9, 2018, issued in corresponding European Patent Application No. EP 15 19 7963.

* cited by examiner

MOBILE DEVICE AND NAVIGATION DEVICE TOLL PAYING SYSTEM AND METHOD

CROSS REFERENCE TO RELATED APPLICATION

This application claims the benefit under 35 U.S.C. § 119(e) of U.S. Provisional Application No. 62/091,352 entitled "MOBILE DEVICE AND NAVIGATION DEVICE TOLL PAYING SYSTEM AND METHOD" filed Dec. 12, 2014, which is incorporated herein by reference.

BACKGROUND

Electronic Toll Collection (ETC)

Over the last three decades, the crowding of highways within metropolitan areas has resulted in the development of additional traffic arteries, including fee-bearing roads known as toll roads. Toll roads have become increasingly prevalent; however, they require the payment of a toll fee for use by vehicular occupants and/or subscribers. The collection of tolls by conventional means has had some negative effects upon highway throughput and safety. Congestion and long backups at toll plazas are becoming more common. Such conditions involve a significant economic cost, through lost time and reduced productivity. The exhaust emissions from a number of idling vehicles at a toll booth has a considerable and negative environmental impact. Moreover, serious accidents at toll plazas, caused by operators or mechanical failures, have also increased in frequency.

Toll authorities have attempted to respond to these problems by providing coin-operated toll collection devices, or by instituting a toll-plate system in which toll-takers visually inspect each incoming vehicle for an appropriate toll plate or sticker. Coin operated toll collection systems do little to increase throughput, and are susceptible to fraud through the use of counterfeit coins. Toll-plate systems suffer the same deficiencies, requiring each vehicle to slow sharply while entering the visual inspection area.

In the 1990's, electronic toll collection (ETC) devices helped to revolutionize toll road travel. One example of an electronic toll collection device is disclosed in U.S. Pat. No. 4,546,241 that issued on Oct. 8, 1985. This patent relates to an electronic identification and recognition system that includes a portable card having a circuit therein for generating and transmitting an identifying signal. The identifying signal includes predetermined frequency pulses. The card functions in cooperation with a reader, which radiates a radio frequency carrier signal received by an antenna in the card. This signal is used both to power the circuit of the card and to provide the basic frequency signal, which is modified to generate secondary frequency signals, which are transmitted back to the reader in a predetermined sequence identifying the card.

Today, those individuals who frequently use toll roads often purchase an electronic toll collection device or tag. The electronic toll collection device or tag allows the vehicular occupant to bypass the cash only toll plaza and, in many instances, the vehicle can maintain its normal speed as it traverses the toll plaza wherein the passage of the electronic toll collection device is recorded. The popularity of the electronic toll collection device has expanded to the point that the normal user of the electronic toll collection device now finds the common lines at toll plazas frustrating, in those instances where they cannot be avoided because the electronic toll collection device is not available.

Tolls on turnpikes, bridges, and other toll facilities are increasingly collected through the use of electronic toll collection devices. The use of such devices to pay tolls is both faster and more convenient than paying in cash or tokens. Electronic toll collections devices allow the toll facility operator to improve customer service and satisfaction by speeding passage through the toll plaza, removing the need for the customer to stop, fumble for change, or roll down a window.

The electronic toll collection device today typically takes the form of a transponder and/or tag that is attached to the inside of the windshield of a vehicle. The toll collection device stores a number identifying a user's account. At a suitably equipped tollbooth or toll plaza, the toll collection device is read to determine the account number, and a user's account is debited by the amount due for the toll. A user's account can be an individual and/or a business entity that represents many individuals. The user must find time to time add money to the account.

Typically, large customer-service centers are staffed to open and maintain accounts, manage toll collection device inventories and distribution, and provide responses to customer questions, complaints and other needs. To obtain a toll collection device, a potential user must visit one of a limited number of such customer-service centers, which can be in an inconvenient or even unsafe location and can have limited hours of operation, or they must order a toll collection device through the mail or over the Internet and then wait for it to arrive. Even users who already have toll collection devices often have to visit customer-service centers to replenish or otherwise manage their accounts. In addition to the inconvenience to the user, such an arrangement imposes a cost on the toll authority, which must hire enough staff to serve all potential customers.

Factors hindering full-speed electronic toll collection include (a) significant non-participation, leading to lines in manual lanes and disorderly traffic patterns as the electronic- and manual-collection cars "sort themselves out" into their respective lanes; (b) problems with pursuing toll evaders; (c) the need, in at least some current (barrier) systems, to confine vehicles in lanes, while interacting with the collection devices, and the dangers of high-speed collisions with the confinement structures; (d) vehicle hazards to toll employees present in some electronic-collection areas; (e) the fact that in some areas at some times, long lines form even to pass through the electronic-collection lanes; and (f) costs and other issues raised when retrofitting existing toll collection facilities.

Despite these factors, however, it is important to recognize that throughput increases if delay at the toll gate is reduced (i.e., if the tollbooth can serve more vehicles per hour). Therefore, many toll collection operations insist that customers purchase a transponder and/or tag up front, in order for them to take advantage of the benefits that electronic toll collection provides. This upfront cost can discourage some from purchasing a transponder and consequently it can be a barrier that reduces the number of potential electronic toll collection users.

Another issue is the desire to implement "open road tolling systems," which are systems that collect tolls only automatically, without manual intervention. Toll authorities need to collect tolls from frequent users, but also desire to provide access to occasional and transitional users such as tourists, business travelers and/or seasonal residents. The cost, time and inconvenience associated with traditional toll collection device distribution, and the inconvenience of account set up, typically mean that authorities need to maintain a fair number of lanes for cash collection tolls.

Some toll roads have already moved to all-electronic collection that uses a combination of RFID tags and "pay by plate." In "pay by plate" the agency deploys a system to capture the license plate image in lieu of the toll collection device. It then accesses the Department of Motor Vehicles (DMV) database to obtain the vehicle owner's information and bills the vehicle owner for the transaction. This typically requires special legislation and expensive camera equipment and is therefore an expensive process to administer that drives up the cost of toll collection.

Typically, a "flat tag" type of transponder is in use for toll collection. The flat tag is a decal sticker or thin card based transponder. Examples include the FasTrak tag used by the Transportation Core Authorities (TCA) in Orange County, Calif., and the eGo Plus Sticker Tag offered by TC IP, Ltd. d/b/a TransCore, for use with TransCore branded or other ANSI INCITS 256-2001 and ISO 10374 compliant tag readers. This type of transponder eliminates the drawbacks associated with the larger box type transponder. Another added benefit of the flat tag is a lower consumer price point. Flat tags are much less expensive to manufacture and can even be disposable. These tags should help toll authorities increase the number of electronic toll users, which is their stated mission.

There are existing patents and applications that suggest using toll "zones" and/or toll "areas" in conjunction with wireless mobile devices such as cell phones for paying tolls. One example of this is set forth and shown in U.S. Patent Publication No. US2007/0285280 and entitled: "Providing toll services using a cellular device". Using "virtual" toll locations in lieu of toll "zones" and/or toll "areas" could be more accurate, timelier and more consistent with existing systems and methods.

Toll road enforcement is accomplished by a combination of a camera which takes a picture of the car and a radio frequency keyed computer which searches for a driver's window/bumper mounted transponder to verify and collect payment. The system sends a notice and fine to cars that pass through without having an active account or paying a toll.

However, this type of implementation has created problems. For example, the New Jersey E-ZPass regional consortium's Violation Enforcement contractor did not have access to the Violation Processing contractor's database of customers. This, together with installation problems in the automated vehicle identification system, led to many customers receiving erroneous violation notices, and a violation system whose net income, after expenses, was negative, as well as customer dissatisfaction. A need exists for additional systems and methods that can eliminate these problems and electronically link to all appropriate existing systems.

Global Position Systems (GPS)

One technology that is finding more applications is global positioning systems (GPS). Through this technology, a geographic location for a person, place or device can be determined within a small margin of error. These devices work by triangulating signals received from at least three satellites orbiting the earth, and then through performance of various calculations, a precise geographic position can be determined. The devices created to perform these calculations have been miniaturized to the point that the components can be incorporated into a chip set which easily fits within handheld mobile device or navigation devices, such as GPS navigation devices from vendors such as Garmin, Magellan, TomTom, Navigon, etc. and/or wireless communication devices such as cell/mobile phone devices, PDAs, etc. GPS receivers are described in several publications and references, such as the U.S. Pat. No. 5,528,248, that issued on Jun. 18, 1996, which is incorporated by reference. This patent discloses a personal Digital Location Assistant based on a GPS Smart Antenna and a computing device.

WAAS stands for Wide Area Augmentation System for the North American continent. Basically, this is a system of satellites and ground stations that provide GPS signal corrections that yield better position accuracy. A WAAS-capable receiver can provide position accuracy of better than three meters (10 feet). Distances measured from an antenna to four or more satellites enable the antenna position to be calculated with reference to the global ellipsoid WGS-84. Local northing, easting and elevation coordinates can then be determined by applying appropriate datum transformation and map projection. By using carrier phase differences in any one of several known techniques, the antenna location can be determined to accuracy on the order of +/−0.1 cm.

A Wi-Fi hotspot is a physical location that offers internet access over a wireless LAN through the use of a shared internet connection and a single router. Wi-Fi hotspots are sometimes referred to as wireless access points or wireless networks open to the public. Wi-Fi hotspots can often be found in coffee shops, restaurants, bowling alleys and various other public places throughout much of North America and Europe.

Navigation Systems

Navigational systems, defined as systems that provide a unit's local position and a way of planning a course around the unit's local position, sometimes to a remote position, such as in-vehicle navigations systems do, are well known in the art. Typically, an in-vehicle navigation system consists of a display screen, processing unit, storage unit, and user input mechanism. The storage system typically contains, for example, maps and travel information used for navigational purposes.

There are numerous mobile devices that can function as navigation devices because they either have a GPS chip inside or are able to connect to a GPS receiver. Examples of these devices include, but are not limited to, GPS navigation devices such as those made by Garmin, Magellan, Navigon and TomTom etc., cell/mobile phone devices, PDAs, music, video players and laptop computers.

Communications Systems

A communications system provides the functionality to provide wireless mobile device users directional information to a desired destination. Incorporated into a wireless mobile device is a position-determining device, such as a GPS device or an equivalent. U.S. Pat. No. 5,815,814 discloses a cellular telephone system that uses the position of a mobile unit to make call management decisions, and is hereby incorporated by reference. The geographic location of the mobile unit is precisely determined using triangulation, a NAVSTAR global positioning system, or its equivalent. Each mobile unit includes a GPS receiver that receives information from a geostationary satellite to determine the precise location of the mobile unit. When a phone user establishes a connection with a particular switch in the wireless network, this positional information from the GPS device is provided and the exact location of the wireless device can be determined.

Advances in telecommunications technology have enabled faster and more accurate location of users carrying mobile devices. Examples of such technology are described in U.S. Pat. Nos. 6,477,362 and 6,477,379. These patents respectively describe systems for directing emergency services to a user based on her or his location and for locating a mobile device with the aid of two or more cell sites. U.S. Pat. No. 7,397,424 describes a system and method for enabling continuous geographic location estimation for wireless computing devices. The system and methods in this patent combine GPS, WiFi, and cellular technologies in order to determine very accurate location information. U.S. Pat. No. 7,397,424.

U.S. Pat. Nos. 5,490,079, 5,721,678, 7,215,255, 7,254,382, and 7,255,264 have been issued for highway toll collection systems.

SUMMARY

The following summary is provided to introduce a selection of concepts in a simplified form that are further described below in the detailed description. This summary is not intended to identify key features or essential features of the claimed subject matter, nor is it intended to be used to limit the scope of the claimed subject matter.

In various implementations, a computer system processes the electronic payment of tolls by storing, on a toll collection server, an accounting record for a mobile user account that is associated with a mobile user and a mobile computing device. A database having a plurality of toll locations and at least one toll that is incurred by the mobile user when the mobile computing device passes the toll location is stored on a toll collection server. An electronic communication containing a notification that the mobile computing device passed the toll location is received. The accounting record is modified on the toll collection server to deduct the amount of the toll from the mobile user account. The toll collection server is coupled to a toll authority server. An electronic payment is sent to the toll authority server in an amount that is associated with the toll.

These and other features and advantages will be apparent from a reading of the following detailed description and a review of the appended drawings. It is to be understood that the foregoing summary, the following detailed description and the appended drawings are explanatory only and are not restrictive of various aspects as claimed.

DETAILED DESCRIPTION

The detailed description provided below in connection with the appended drawings is intended as a description of examples and is not intended to represent the only forms in which the present examples can be constructed or utilized. The description sets forth functions of the examples and sequences of steps for constructing and operating the examples. However, the same or equivalent functions and sequences can be accomplished by different examples.

References to "one embodiment," "an embodiment," "an example embodiment," "one implementation," "an implementation," "one example," "an example" and the like, indicate that the described embodiment, implementation or example can include a particular feature, structure or characteristic, but every embodiment, implementation or example can not necessarily include the particular feature, structure or characteristic. Moreover, such phrases are not necessarily referring to the same embodiment, implementation or example. Further, when a particular feature, structure or characteristic is described in connection with an embodiment, implementation or example, it is to be appreciated that such feature, structure or characteristic can be implemented in connection with other embodiments, implementations or examples whether or not explicitly described.

Numerous specific details are set forth in order to provide a thorough understanding of one or more aspects of the described subject matter. It is to be appreciated, however, that such aspects can be practiced without these specific details. While certain components are shown in block diagram form to describe one or more aspects, it is to be understood that functionality performed by a single component can be performed by multiple components. Similarly, a single component can be configured to perform functionality described as being performed by multiple components.

Figure 1A:
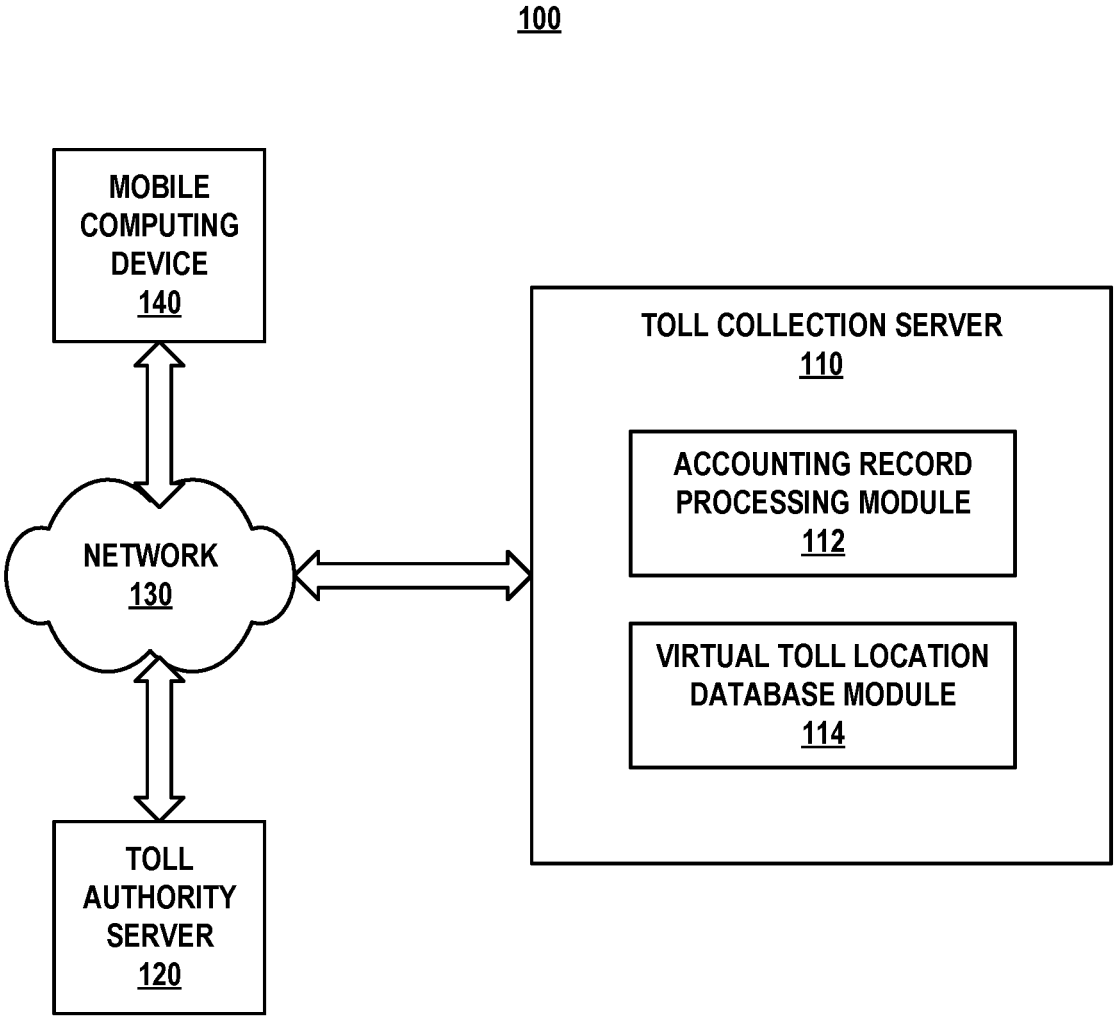
FIG. 1A illustrates an embodiment of an exemplary computer system that can implement aspects of the described subject matter.
Figure 1B:
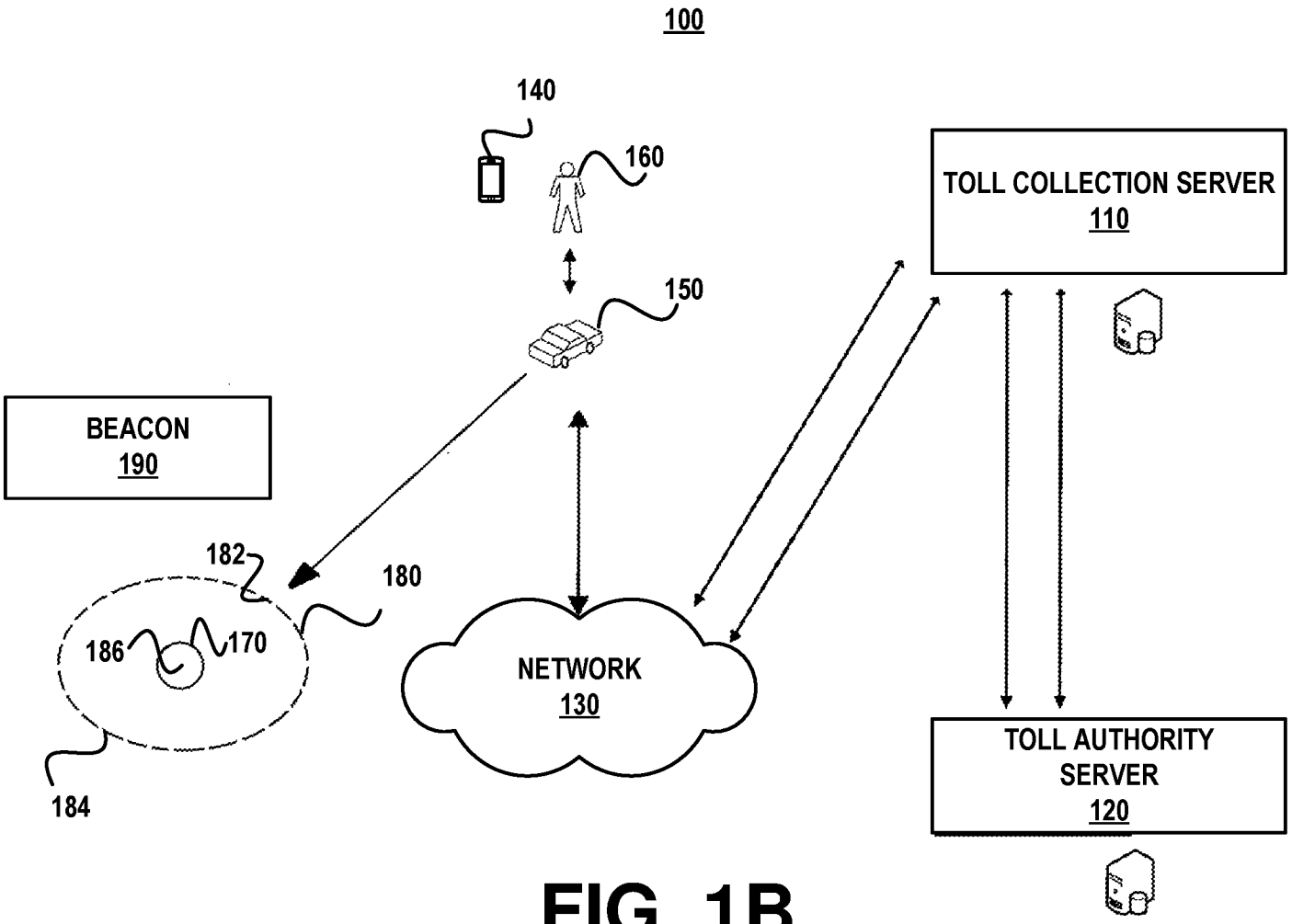
FIG. 1B illustrates an embodiment of an exemplary system that can implement aspects of the described subject matter.

Referring to FIGS. 1A and 1B, computer system 100 is illustrated as an embodiment of an exemplary computer system that can implement aspects of the described subject matter. It is to be appreciated that aspects of the described subject matter can be implemented by various types of operating environments, computer networks, platforms, frameworks, computer architectures, and/or computing devices.

Implementations of computer system 100 are described in the context of a system configured to perform various steps, methods, and/or functionality in accordance with aspects of the described subject matter. It is to be appreciated that a computer system can be implemented by one or more computing devices. Implementations of computer system 100 also are described in the context of "computer-executable instructions" that are executed to perform various steps, methods, and/or functionality in accordance with aspects of the described subject matter.

In general, a computer system can include one or more processors and storage devices (e.g., memory and disk drives) as well as various input devices, output devices, communication interfaces, and/or other types of devices. A computer system also can include a combination of hardware and software. It can be appreciated that various types of computer-readable storage media can be part of a computer system. As used herein, the terms "computer-readable storage media" and "computer-readable storage medium" do not mean and unequivocally exclude a propagated signal, a modulated data signal, a carrier wave, or any other type of transitory computer-readable medium. In various implementations, a computer system can include a processor configured to execute computer-executable instructions and a computer-readable storage medium (e.g., memory and/or additional hardware storage) storing computer-executable instructions configured to perform various steps, methods, and/or functionality in accordance with aspects of the described subject matter.

Computer-executable instructions can be embodied and/or implemented in various ways such as by a computer program (e.g., client program and/or server program), a software application (e.g., client application and/or server application), software code, application code, source code, executable files, executable components, program modules, routines, application programming interfaces (APIs), functions, methods, objects, properties, data structures, data types, and/or the like. Computer-executable instructions can be stored on one or more computer-readable storage media and can be executed by one or more processors, computing devices, and/or computer systems to perform particular tasks or implement particular data types in accordance with aspects of the described subject matter.

As shown, computer system 100 includes toll collection server 110 implemented by computing devices such as server computers configured to provide various types of services and/or data stores in accordance with aspects of the described subject matter. Toll collection server 110 can be configured to implement accounting records processing module 112 and virtual toll location database module 114.

In various implementations, toll collection server 110 is coupled to toll authority server 120 over network 130. Toll authority server 120 can be implemented by computing devices such as server computers configured to provide various types of services and/or data stores in accordance with aspects of the described subject matter. It should be understood that computer system 100 can include multiple toll authority servers, including toll authority server 120.

Computer system 100 also includes a mobile computing device 140, which can be a mobile device, a navigation device, a smartphone, a handheld computer, a tablet or any other mobile client device. Mobile computing device 140 can be transported in a vehicle, can be mounted in a vehicle and/or can be integrated into a vehicle. In some embodiments, mobile computing device 140 can link with and/or otherwise utilize the GPS system within the vehicle, which can be more accurate than the GPS system within mobile computing device 140.

Mobile computing device 140 can be configured to communicate over network 130 with toll collection server 110. It is to be understood that mobile computing device is provided for purposes of illustration and that computer system 100 can include a greater number of client devices and/or mobile computing devices. It should also be understood that mobile computing device 140 can be integrated into a vehicle, such as vehicle 150, and can be transported by a vehicle.

Network 130 can be implemented by any type of network or combination of networks including, without limitation: a wide area network (WAN) such as the Internet, a local area network (LAN), a Peer-to-Peer (P2P) network, a telephone network, a private network, a public network, a packet network, a circuit-switched network, a wired network, and/or a wireless network. Toll collection server 110, toll authority server 120, mobile computing device 140 can communicate via network 130 using various communication protocols (e.g., Internet communication protocols, WAN communication protocols, LAN communications protocols, P2P protocols, telephony protocols, and/or other network communication protocols), various authentication protocols, and/or various data types (web-based data types, audio data types, video data types, image data types, messaging data types, signaling data types, and/or other data types). It should be understood that mobile computing device 140 can communicate via network 130 when it is being transported in a vehicle, is mounted in a vehicle or is integrated into a vehicle.

Toll collection server 110 and toll authority server 120 can be implemented by one or more computing devices such as server computers configured to provide various types of services and/or data stores in accordance with aspects of the described subject matter. Exemplary severs computers can include, without limitation: web servers, front end servers, application servers, database servers, domain controllers, domain name servers, directory servers, and/or other suitable computers.

Computer system 100 can be implemented as a distributed computing system in which components are located on different computing devices that are connected to each other through network (e.g., wired and/or wireless) and/or other forms of direct and/or indirect connections. Components of computer system 100 can be implemented by software, hardware, firmware or a combination thereof. For example, computer system 100 can include components implemented by computer-executable instructions that are stored on one or more computer-readable storage media and that are executed to perform various steps, methods, and/or functionality in accordance with aspects of the described subject matter.

Referring to FIGS. 1A and 1B, computer system 100 can be implemented to provide a fast, convenient and cost effective process for subscribing to, activating, and paying tolls electronically via wireless mobile devices or navigation devices. Computer system 100 can collect tolls electronically through applications and/or services on toll collection server 110 and/or mobile computing device 140. These applications and/or services eliminate the need to attach a transponder and/or tag to the inside of the windshield of a vehicle. These applications and/or services eliminate the need for customers to make an advance purchase of a transponder and/or tag to take advantage of the benefits that electronic toll collection provides. These applications and/or services eliminate the need for the cost, time and inconvenience associated with traditional toll collection device distribution, and the inconvenience of account set up.

Computer system 100 processes the electronic payment of tolls by storing a plurality of accounting records on toll collection server 110. Toll collection server 110 is configured to implement accounting records processing module 112 to manage the accounting records. Each accounting record can be associated with a mobile computing device, such as mobile computing device 140. Each mobile computing device 140 is operated by at least one mobile user 160 that is associated with the mobile computing device 140 while riding in or otherwise operating a vehicle. It should be understood that mobile user 160 includes a driverless, autonomous and/or self-driving car.

Mobile computing device 140 can be configured to alert user 160 that his or her vehicle will soon be driving on toll roads. Toll collection server 110 can communicate with mobile computing device 140 to implement a software application on the device screen to provide user 160 with the option to pay tolls. The software application can integrate a payment option to the server through mobile computing device 140 to provide a convenient nation-wide toll paying capability to user 160.

Mobile computing device 140 can include vehicle location detection capability (e.g., GPS, Wi-Fi, or an equivalent) that can provide location information to the toll location server 110. Alternatively, computer system 100 can be configured to implement to utilize mobile computing device 140 with no vehicle location detection capability.

Computer system 100 stores a toll location database on toll collection server 110. Toll collection server 110 can implement and utilize virtual toll location database module 114 to manage the toll location database, which contains a plurality of virtual toll locations. Virtual toll location database module 114 can be configured to determine the amount of at least one toll that is incurred by user 160 when mobile computing device 140 passes toll location 170 in a vehicle. The toll location 170 can correspond to a physical toll booth or to a virtual toll location.

Computer system 100 can be configured to communicate with mobile computing device 140 to determine whether computing device 140 is owned by a registered user and/or whether user 160 is a registered user. A registered user can access a software application that is specific to the registered user's account information, such as registration information relating to his or her mobile computing device(s), vehicle information (e.g., license plate number, make of vehicle, and equivalent information), and other similar information. The software application can reside on toll collection server 110, mobile computing device 140 or elsewhere on network 130.

Toll collection server 110 can obtain and store all the registered user's information (e.g., mobile device or navigation device number, vehicle license plate number, and equivalents) in accounting record in advance of the toll collection. Toll collection server 110 can obtain the necessary information from mobile computing device 140 upon request.

Toll collection server 110 receives an electronic communication that contains a notification that indicates that mobile computing device 140 and/or vehicle 150 has passed toll location 170. When toll location server 110 receives the notification, toll location server 110 implements and utilizes accounting records processing module 112 to modify the user's accounting records to deduct the amount of the toll from the mobile user account. Toll location server 110 can send an electronic payment to toll authority server 120 in an amount that is associated with the toll. Toll location server 110 can pay tolls to toll authority server 120 in advance, by choice of user 160, or after receiving a toll evader list from toll authority server 120.

It should be understood that vehicle 150 can be a car, truck, bus, automobile, train, subway car, light rail or other similar vehicle. Vehicle 150 can be operated by an individual, an employee of a car service or other similar entity, or by an employee of a public mass transportation system.

Toll collection server 110 can send a confirmation to mobile computing device 140 when a toll payment is completed successfully. Toll collection server 110 can log payments in a history log in a software application residing on mobile computing device 140 for use by user 160. The history log can include the name of the toll, the payment amount, and the nickname and last four digits of the payment card that was used.

Computer system 100 can be configured to accept real time payments in the same manner in which drivers physically stop at toll booths to pay cash to a cashier. Toll location server 110 can send a push notification to mobile computing device 140 based on the geolocation of the user once the user approaches a geofence 180 located within a predetermined radius (e.g., 350 meter radius) to the approaching toll booth and/or toll location 170. Toll location server 110 can implement a pre-payment option to allow for a user to take advantage of express lanes to free up traffic.

Toll collection server 110 can be configured to communicate and alert user 160 once he or she has crossed over toll bridges, have driven in toll roads, or have driven in lanes. Toll collection server 110 can be configured to transfer the balance due by user 160. Toll collection server 110 can be configured to utilize toll booths that include physically enabled license plate readers to cross reference user 160 with toll payments. Toll collection server 110 can be configured to allow user 160 to pre-register their license plate information to confirm that user 160 is a non-violator. Toll collection server 110 can communicate this information to toll authority server 120 in real-time or in a daily list of customers paying the toll to the toll authorities.

Computer system 100 can be configured to perform payment processing by utilizing the Braintree Payment Gateway (or an equivalent), which is PCI compliant. To accept and save payment cards, computer system 100 can implement and utilize the Braintree SDK (or an equivalent) to encrypt the card information and save it in a secure place called a Vault. Computer system 100 can be configured, so that toll location server 110 does not have access to the actual payment card number and other sensitive card information because the card information is encrypted by Braintree (or an equivalent) and can only be decrypted by Braintree (or an equivalent).

Toll collection server 110 can be configured to receive the encrypted payment card information when mobile computing device 140 makes a payment through computer system 100. Toll collection server 110 can send the encrypted payment information to the Braintree Payment Gateway (or an equivalent) and it will be decrypted on the Braintree (or an equivalent) side to guarantee a secure payment.

Computer system 100 can be configured to allow user 160 to reach customer support using an application customer support form. This form can be filled-out and sent to a customer support team while staying within the application. User 160 does not need to look for a customer support email address, open and compose their emails in a third party email client because everything can be done within the application.

Referring now to FIG. 1B with continuing reference to the foregoing figures, toll collection server 110 can be configured to implement virtual toll location database module 114. Virtual toll location database module 114 has the ability to identify or to define one or more waypoints to define "virtual" toll locations and/or "virtual" toll barriers and/or "virtual" toll boundaries by recording highly accurate waypoints that correspond to the actual physical locations of toll plazas, toll bridges, toll tunnels, etc., such as toll location 170.

Toll collection server 110 can be configured to implement virtual toll location database module 114 to incorporate the use of beacon 190 (i.e., a Wi-Fi hotspot or equivalent) to define "virtual" toll locations and/or "virtual" toll barriers and/or "virtual" toll boundaries by creating toll locations using that correspond to the actual physical location of toll locations, such as toll location 170. Virtual toll location database module 114 can facilitate the ability of mobile computing device 140 to sense when it approaches a "virtual" toll locations, such as toll location 170, and/or a "virtual" toll barriers and/or "virtual" boundaries (i.e., geofence 180) and when they have passed them. Virtual toll location database module 114 can be configured to implement and utilize "virtual" toll locations and/or "virtual" toll barriers and/or "virtual" boundaries to implement an open road tolling system by subscribing to a service provided by toll location server 110.

In various implementations, toll collection server 110 can be configured to determine how many miles vehicle 150 has driven on a toll road so that ETC could be a function of miles actually driven instead of a function of passing toll location 170. Toll collection server 110 can be configured to provide users self-service management of their accounts via network 130 and/or mobile computing device 140.

Toll collection server 110 can be configured to communicate with mobile computing device 140 to provide a confirmation (SMS or text, vibration, voice, audible alert, email, or equivalents) to user 160 indicating the amount paid and current status of the account. Toll collection server 110 can provide a confirmation (SMS or text, vibration, voice, audible alert, email, or equivalents) to mobile computing device 140 indicating that user 160 has entered a toll road with the electronic toll collection service deactivated and that user 160 can incur violations if they pass any toll locations.

Toll collection server 110 can be configured to increase GPS position measurements within geofence 180 and to decrease GPS position measurements outside of geofence 180 to reduce battery use by mobile computing device 140 and/or vehicle 150. In some embodiments, toll collection server 110 can obtain the highest accuracy readings of GPS position data within geofence 180.

Toll collection server 110 can determine when mobile computing device 140 and/or vehicle 150 enters geofence 180 at entry point 182 and exits geofence 180 at exit point 184. In some embodiments, toll collection server 110 can determine the direction that mobile computing device 140 and/or vehicle 150 is travelling by determining when mobile computing device 140 and/or vehicle 150 crosses geofence center point 186, which can be advantageous for one-way tolls.

In some embodiments, toll collection server 110 can trace the path of mobile computing device 140 and/or vehicle 150 within geofence 180 more accurately by increasing the frequency of GPS position measurements. Toll collection server 110 can monitor on-ramp usage and/or off-ramp usage within geofence 180.

Mobile computing device 140 can be configured to implement application(s) and/or service(s) that can link to toll collection server 110 to provide a fully-interactive, real-time, linkage (via terrestrial, cell towers, wireless Internet, radio or satellite communication) to permit user 160 to view the status of his or her toll charges and to manage his or her account.

Toll collection server 110 can process ETC for mobile computing device 140, which can be linked to one or more specific vehicle(s) and billing account(s) with a service provider(s), third party(s) and/or toll authority(s). Toll collection server 110 can be configured to determine when mobile computing device 140 device passes toll location 170, and/or a "virtual" toll barriers and/or "virtual" boundaries (i.e., geofence 180) and incurs a toll that is to be paid by user 160. Toll collection server 110 can be configured to determine whether user 160 has activated an electronic toll collection payment service associated with mobile computing device 140.

Toll collection server 110 can be configured to send a charge transaction to a service provider(s), third party(s) and/or directly to toll authority server 130. Toll collection server 110 can indicate that the toll has not been paid by user 160 and can generate a billing record for user 160 at toll collection server 110. Toll collection server 110 can send a non-charge transaction to a service provider(s) and or third party(s) and/or directly to toll authority server 130 to indicate that the toll has been billed to user 160 via the service provider(s) and/or third party(s).

Toll collection server 110 can be configured to send a confirmation (SMS or text, vibration, voice, audible alert, email, etc.) to mobile computing device 140 indicating the amount paid and/or billed and the current status of the account after every transaction.

Referring to FIG. 1B with continuing reference to the foregoing figures, computer system 100 can be configured to implement geofencing of toll roads and bridges. Geofencing is accomplished by building virtual toll road entry points on toll collection server 110 by taking a physical tollbooth and creating a virtual one using virtual toll location database module 114. Each virtual tollbooth shall be located at predetermined radius around each virtual toll location 170.

Toll collection server 110 can be configured to send a push notification or message to mobile computing device 140 when mobile computing device 140 is located within geofence 180 of toll location 170. The push notification or message can indicate that user 160 has incurred a toll and can request a real time payment. Toll collection server 110 can be configured to send a voice activated, video confirmation, or pressing a pay button. Toll collection server 110 can be configured to accept a pre-payment or post payment based on user safety or comfort, or a grace period can be given to user 160.

Computer system 100 can be configured to utilize beacon 190, which can be a proximity beacon or an equivalents thereof, to enhance the accuracy of the location of user 160. Multiple hardware beacons 190 can be deployed at all toll booths or toll locations 170 that act as the hardware which interacts with mobile computing device 140. Computer system 100 can be implemented to utilize beacons that interact with Bluetooth-enabled vehicles, such as vehicle 150, and mobile devices, such as mobile device 140, by sending out low Bluetooth signals. Beacon 190 can pick up the proximity of mobile device 140 or vehicle 150 as it approaches beacon 190. Computer system 100 can be implemented to utilize three specific time stamp and location points that are recorded to enhance the accuracy of the location beyond just GPS coordinates. Geofencing and beacons, such as beacon 190, can cooperate to enhance the overall user experience and the accuracy of the locations of vehicles, such as vehicle 150.

Computer system 100 can be configured to monitor nearby tolls by utilizing radial or polygonal geofencing technology that creates a virtual circular fence, such as geofence 180, with the toll location 170 (geolocation) at the center. When user 160 enters this circular region, mobile computing device 140 triggers a notification or alert from toll location server 110 that indicates that user 160 is in close proximity of toll location 170 (and can incur a toll) and prompts user 160 to make a payment. In instances in which user 160 can incur a toll in only one direction, computer system 100 can be configured to determine if user 16-is approaching the toll from the side where payment is required (the entrance side) or the other (exit) side. Mobile computing device 140 can display a payment prompt notification/alert to user 160 only if user 160 is approaching toll location 170 from the entrance side.

Exemplary Mobile Computing Devices

Figure 2A:
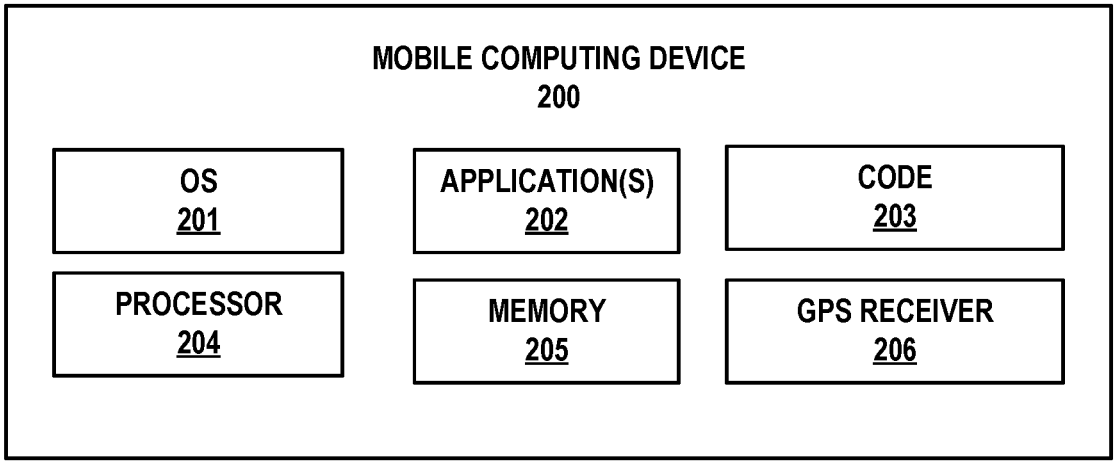
FIG. 2A illustrates an embodiment of an exemplary mobile device that can implement aspects of the described subject matter.
Figure 2B:
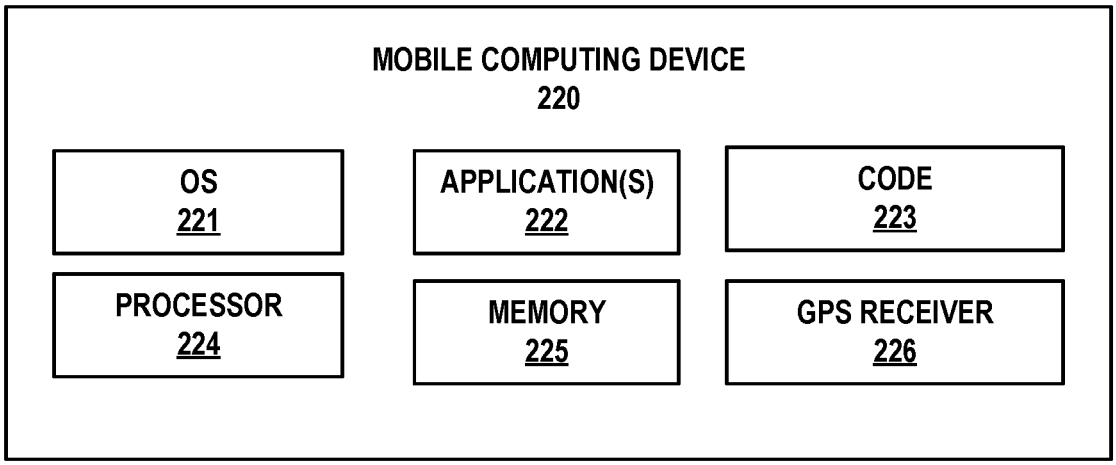
FIG. 2B illustrates an embodiment of an exemplary navigation device that can implement aspects of the described subject matter.

Referring now to FIGS. 2A and 2B with continuing reference to the foregoing figures, mobile computing devices 200 and 220 are illustrated as embodiments of exemplary mobile computing devices that can implement aspects of the described subject matter. It is to be appreciated that aspects of the described subject matter can be implemented by various computer systems and/or computing devices, such as mobile computing device 140 within computer system 100.

FIG. 2A illustrates mobile computing device 200 as a mobile computer having a variety of hardware and software components that can communicate with each other. Mobile computing device 200 can represent any of the various types of mobile computing devices described herein and can allow wireless two-way communication over a network, such as one or more mobile communications networks (e.g., cellular and/or satellite network), a LAN, and/or a WAN.

Mobile computing device 200 can include operating system 201 and various types of mobile application(s) 202. In some implementations, mobile application(s) 202 can include one or more client application(s) and/or components of navigation application code 203.

Mobile computing device 200 can include processor 204 for performing tasks such as signal coding, data processing, input/output processing, power control, and/or other functions.

Mobile computing device 200 can include memory 205 that can be used for storing data and/or code for running operating system 201 and/or mobile application(s) 202. Example data can include web pages, text, images, sound files, video data, or other data to be sent to and/or received from one or more network servers or other devices via one or more wired and/or wireless networks. Memory 205 can be used to store a subscriber identifier. Such identifiers can be transmitted to a network server to identify user 160 and equipment.

Mobile computing device 200 can further include Global Positioning System (GPS) receiver 206 or other type of a satellite navigation system receiver. It can be appreciated the illustrated components of mobile computing device 200 are not required or all-inclusive, as various components can be omitted and other components can be included in various embodiments.

Mobile application(s) 202 can be configured to implement navigation application code 203 to communicate with toll collection server 110 to provide the account information for user 160, such as information for mobile device 200 and information for vehicle 150 (e.g., license plate number, make of vehicle, and equivalent information). Toll collection server 110 can communicate with toll authority server 120 to pay tolls in advance by choice of user 160 or after receiving a toll evader list from any participating toll agency.

FIG. 2B illustrates mobile computing device 220 as a navigation device having a variety of hardware and software components that can communicate with each other. Mobile computing device 220 can represent any of the various types of mobile computing devices described herein and can allow wireless two-way communication over a network, such as one or more mobile communications networks (e.g., cellular and/or satellite network), a LAN, and/or a WAN.

Mobile computing device 220 can include an operating system 221 and various types of mobile application(s) 222. In some implementations, mobile application(s) 222 can include one or more client application(s) and/or components of navigation application code 223.

Mobile computing device 220 can also include processor 224, memory 225, and Global Positioning System (GPS) receiver 226 or other type of a satellite navigation system receiver.

Mobile application(s) 222 can be configured to implement navigation application code 223 to communicate with toll collection server 110 to provide account information for user 160, such as information relating to mobile computing device 220 and information relating to vehicle 150 (e.g., license plate number, make of vehicle, and equivalent information). Toll collection server 110 communicates with toll authority server 120, either in advance by choice of user 160, or after receiving a toll evader list from any participating toll agency.

Mobile application(s) 222 can be a single software application that includes vehicle location detection capability (e.g., GPS, Wi-Fi, or an equivalent) that can provide location information to the toll collection server 110. Mobile application(s) 222 can include multiple software applications with one application being a native application having no vehicle location detection capability and a second third party application having the ability to provide vehicle location to toll location server 110 either directly or indirectly.

Exemplary User Interfaces

FIGS. 3A-D illustrate user interfaces 300, 320, 340, 360 as embodiments of exemplary user interfaces that can implement aspects of the described subject matter. It is to be appreciated that aspects of the described subject matter can be implemented by various types of user interfaces that can be presented by mobile computing devices 140, 200 and/or 220 or other suitable computing device and/or provided by computer system 100 or other suitable computer systems.

Figure 3A:
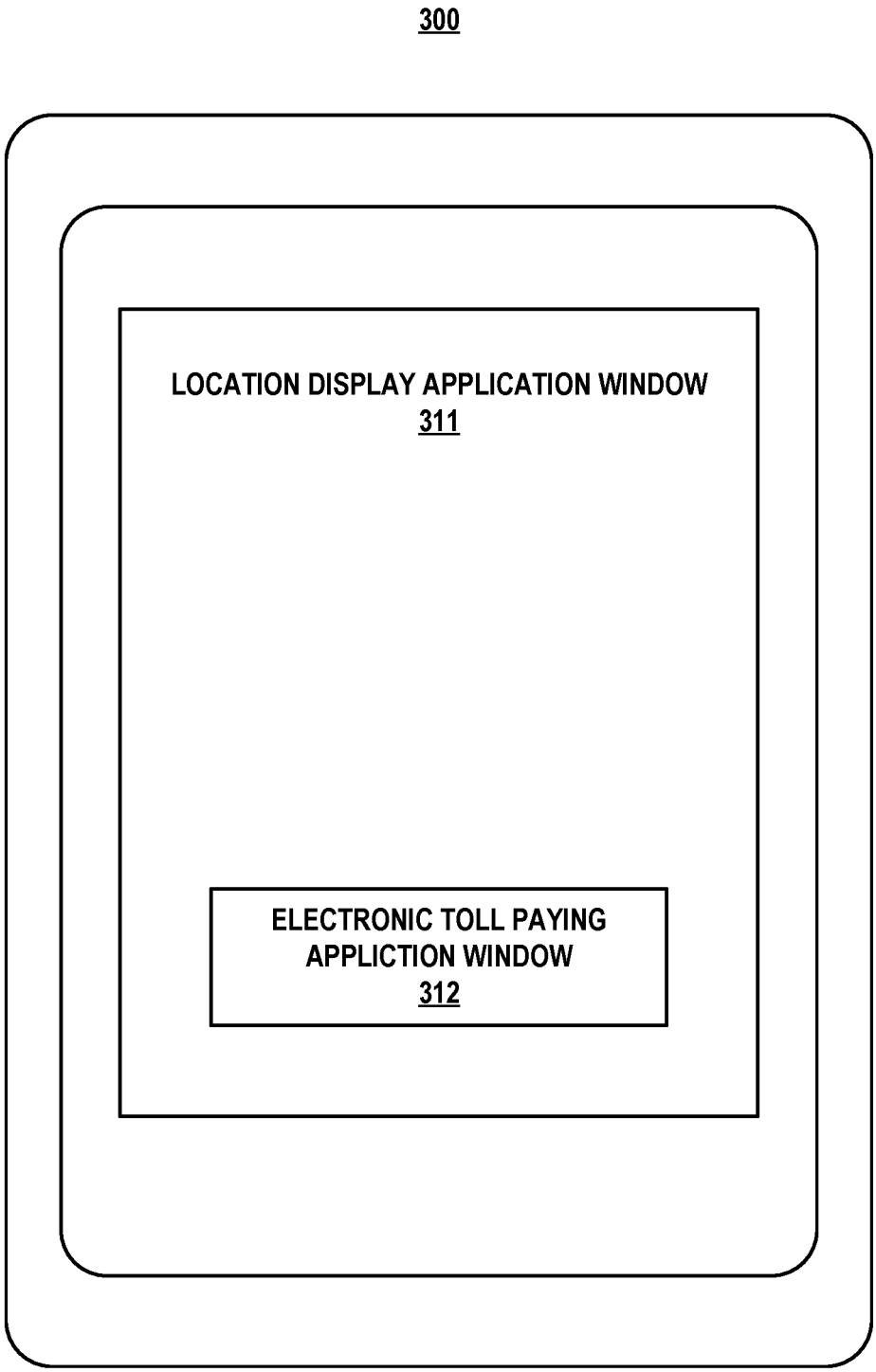
FIG. 3A illustrates an embodiment of an exemplary user interface in accordance with aspects of the described subject matter.

Referring to FIG. 3A with continuing reference to the foregoing figures, user interface 300 can be displayed by mobile computing devices 140, 200 and/or 220 as a visual representation of an application (e.g., a navigation application, a location application, or an equivalent application that provides position information) that provides location information to user 160. An electronic toll paying application that is connected to a main server also has a window 312 inside display window 311. In various embodiments, window 312 can be placed anywhere inside display window 311. Window 312 would provide graphics and/or text information to user 160 to indicate any upcoming toll location 170 and allow user 160 to decide whether to pay the toll that is incurred when user 160 passes toll location 170.

Figure 3B:
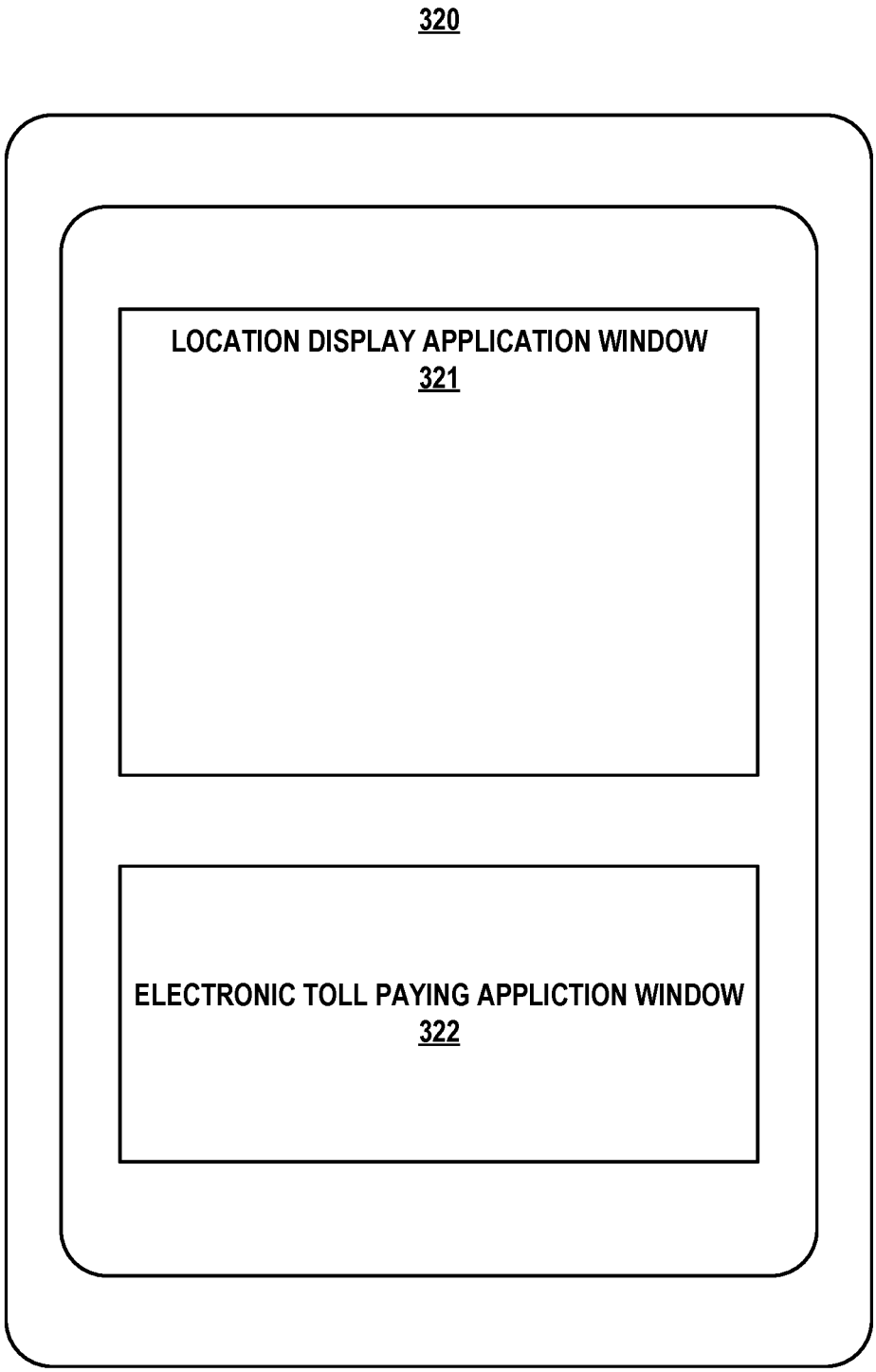
FIG. 3B illustrates an embodiment of an exemplary user interface in accordance with aspects of the described subject matter.

Referring to FIG. 3B with continuing reference to the foregoing figures, user interface 320 can be displayed by mobile computing devices 140, 200 and/or 220 in accordance with one embodiment of the invention. User interface 320 includes display window 321 of an application (e.g., a navigation application, a location application, or an equivalent application that provides position information) that provides location information to user 160. An electronic toll paying application that is connected to a main server has window 322 outside display window 321. Window 322 can be placed anywhere outside display window 321. Window 322 provides graphics and/or text information to user 160 to indicate any upcoming toll and allow user 160 to decide whether to pay the toll through computer system 100.

Figure 3C:
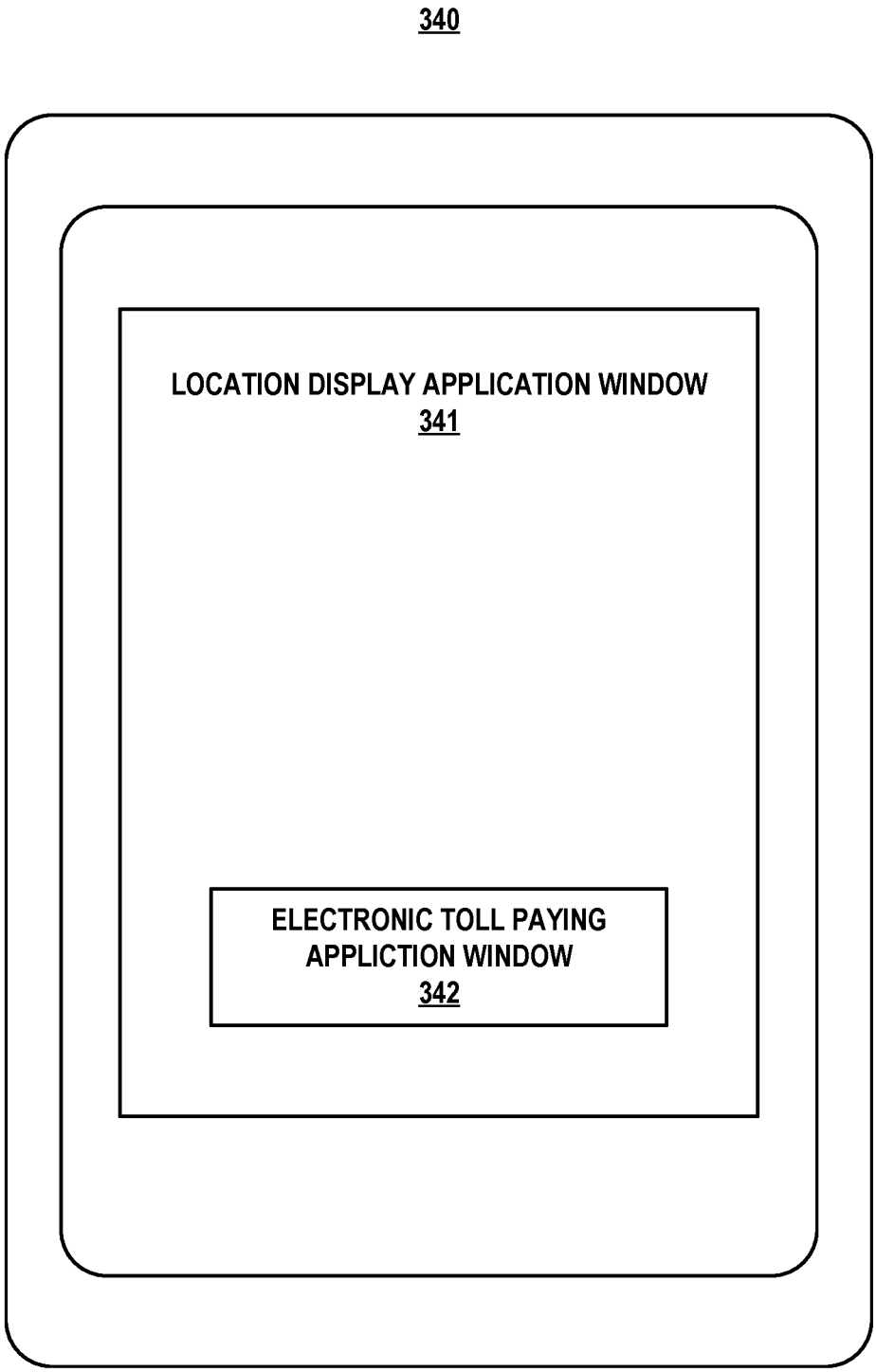
FIG. 3C illustrates an embodiment of an exemplary user interface in accordance with aspects of the described subject matter.

Referring to FIG. 3C with continuing reference to the foregoing figures, user interface 340 can be displayed by mobile computing devices 140, 200 and/or 220. User interface 340 can include display window 341 that provides location information to user 160. An electronic toll paying application that is connected to toll collection server 110 has window 342 inside display window 341. Window 342 can be placed anywhere inside display window 341. Window 342 provides graphics and/or text information to user 160 to indicate any upcoming toll to be incurred and allows user 160 to decide whether or not to pay the toll through computer system 100.

Figure 3D:
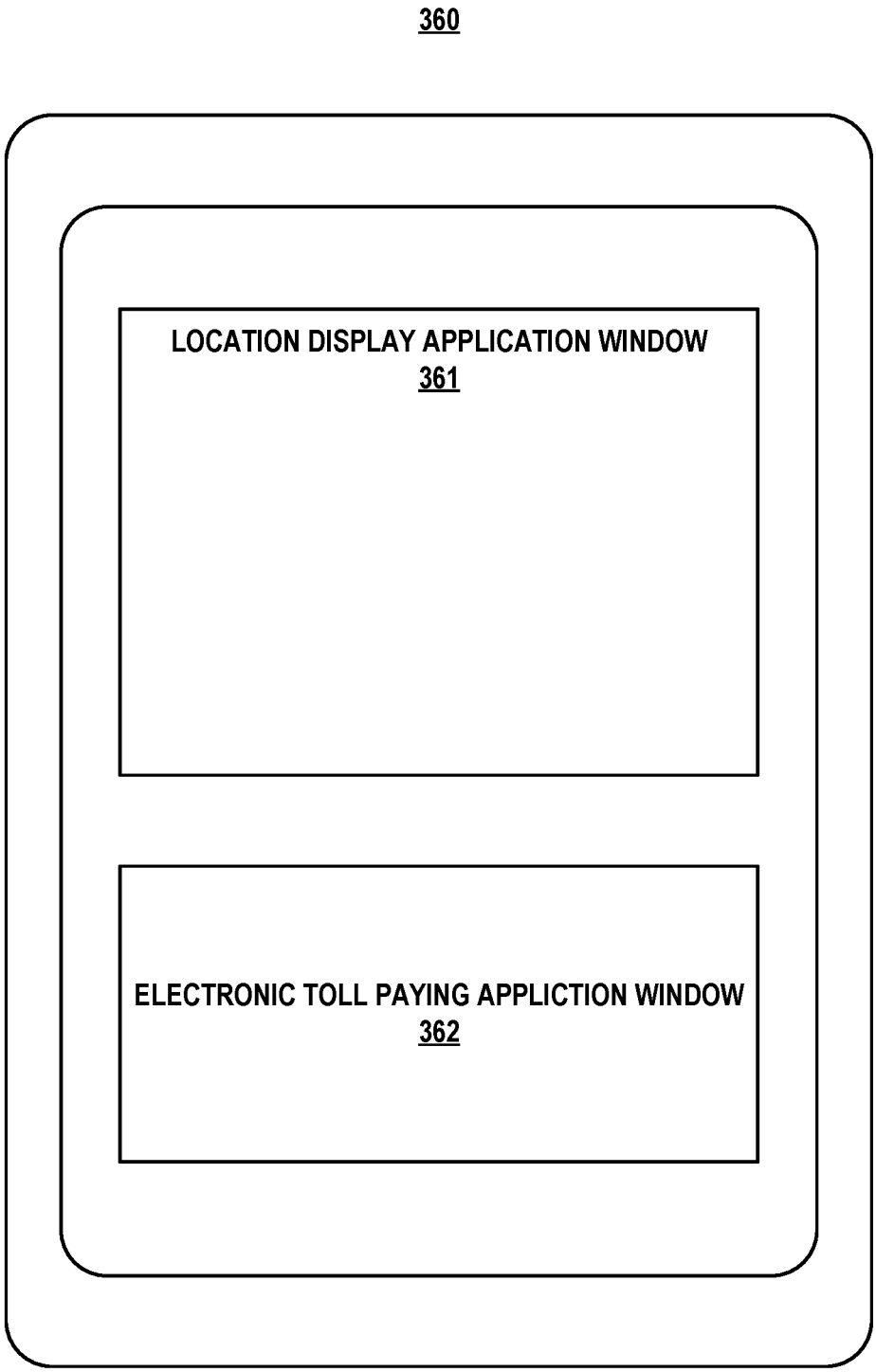
FIG. 3D illustrates an embodiment of an exemplary user interface in accordance with aspects of the described subject matter.

Referring to FIG. 3D with continuing reference to the foregoing figures, user interface 360 can be displayed by mobile computing devices 140, 200 and/or 220. User interface 360 includes display window 361 that provides location information to user 160. An electronic toll paying application that is connected to toll collection server 110 has window 362 outside display window 361. Window 362 can be placed anywhere outside display window 361. Window 362 provides graphics and/or text information to user 160 to indicate any upcoming toll to be incurred and allows user 160 to decide whether or not to pay the toll through computer system 100.

Exemplary Processes

Figure 4A:
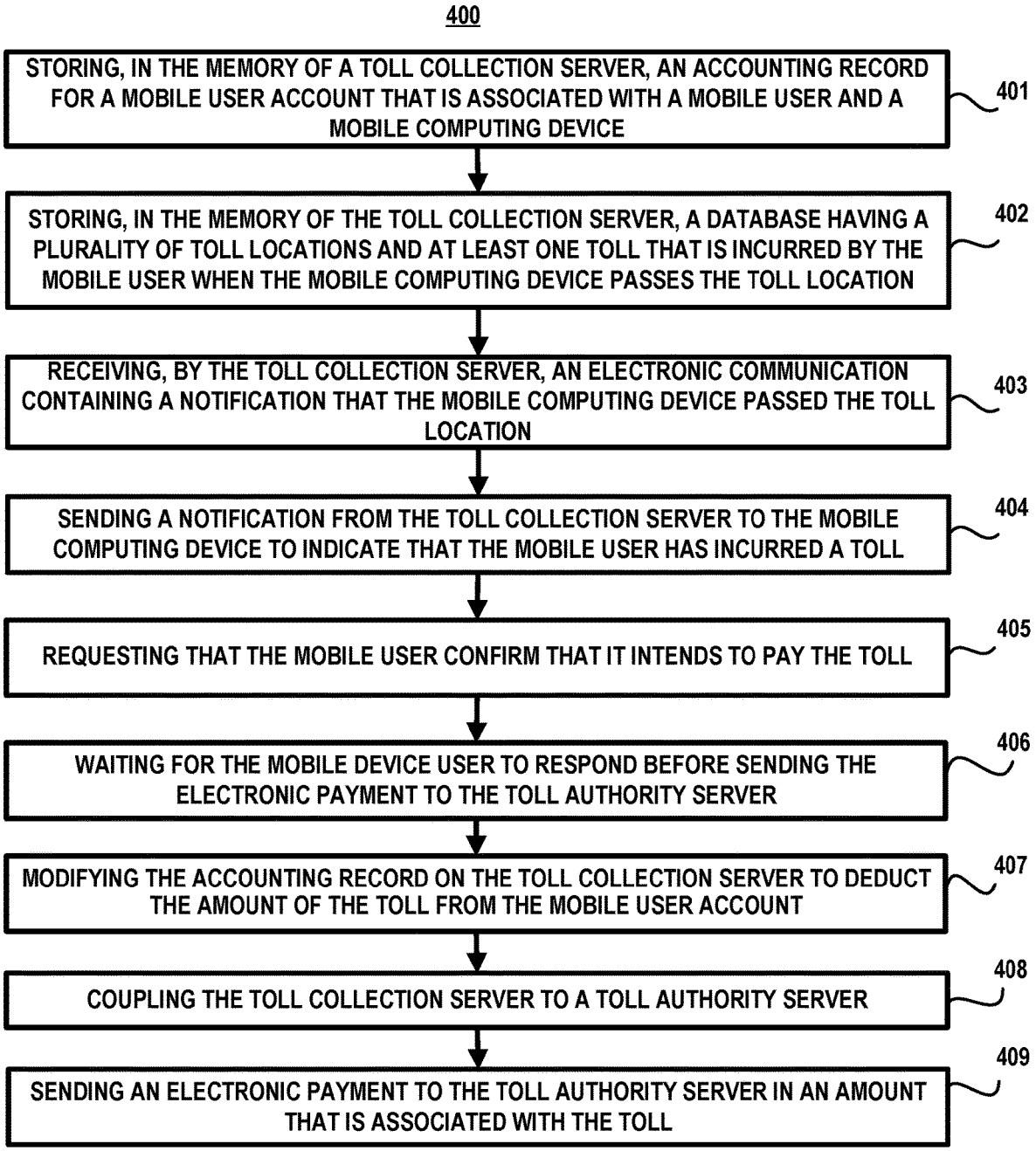
FIG. 4A illustrates an embodiment of an exemplary process in accordance with aspects of the described subject matter.

Referring to FIG. 4A with continuing reference to the foregoing figures, a computer-implemented method 400 is illustrated as an embodiment of an exemplary electronic toll collection process in accordance with aspects of the described subject matter. Computer-implemented method 400, or portions thereof, can be performed by one or more computing devices, a computer system, computer-executable instructions, software, hardware, firmware or a combination thereof in various embodiments. For example, computer-implemented method 400 can be performed by computer system 100 or other suitable computer system.

At 401, a computer system can store, in the memory of a toll collection server, an accounting record for a mobile user account that is associated with a mobile user and a mobile computing device. For example, computer system 100 can implement and utilize toll collection server 110 to store accounting record by implementing and utilizing accounting record processing module 112. Accounting record can include a mobile user account that is associated with mobile user 160 that utilizes mobile computing devices 140, 200 and/or 220.

At 402, the computer system can store, in the memory of the toll collection server, a database having a plurality of toll locations and at least one toll that is incurred by the mobile user when the mobile computing device passes the toll location. In this exemplary embodiment, computer system 100 can implement and utilize toll collection server 110 to store virtual toll collection database 160. Virtual toll collection database 160 includes a plurality of toll locations, such as toll location 170, and sufficient information to determine at least one toll that is incurred by a mobile user when mobile computing device 140 passes at least one toll location, such as toll location 170. The toll collection server 110 can store in virtual toll collection database 160 a plurality of virtual tollbooths with each virtual tollbooth corresponding to a geographic toll collection location, such as toll location 170.

At 403, the computer system can receive, by the toll collection server, an electronic communication containing a notification that the mobile computing device passed the toll location. In this exemplary embodiment, computer system 100 can implement and utilize toll collection server 110 to receive an electronic communication containing a notification that mobile computing device 140 passed toll location 170. It should be understood that toll collection server 110 and mobile computing device 140 can utilize GPS receiver 206 and/or 226 to determine the geographic location of mobile computing device 140 to determine whether mobile user 160 has passed toll location 170 to incur a toll.

At 404, the computer system can send a notification from the toll collection server to the mobile computing device to indicate that the mobile user has incurred a toll. In this exemplary embodiment, computer system 100 can implement and utilize toll collection server 110 to send a notification to mobile computing device 140 that mobile user 160 has incurred a toll. Mobile computing devices 140, 200, and/or 220 can utilize application(s) 202 and/or 222 to display the notification to mobile user 160.

At 405, the computer system can request that the mobile user confirm that it intends to pay the toll. In this exemplary embodiment, computer system 100 can utilize application(s) 202 and/or 222 to generate a screen that requests input from mobile user 160 to confirm that he or she intends to pay the toll.

At 406, the computer system can wait for the mobile device user to respond before sending the electronic payment to the toll authority server. In this exemplary embodiment, mobile user 160 can respond using mobile computing devices 140, 200 and/or 220 to notify the toll collection server 110 that he or she intends to pay the toll. It should be understood that toll collection server 110 has the ability to wait for mobile user 160 to respond before paying the toll and/or has the ability to wait a predetermined period of time before paying the toll regardless as to whether toll collection server 110 actually receives a response from mobile user 160.

At 407, the computer system can modify the accounting record on the toll collection server to deduct the amount of the toll from the mobile user account. In this exemplary embodiment, computer system 100 implements and utilizes accounting record processing module 112 to modify accounting record on toll collection server 110 and deducts the amount of the toll from the account corresponding to mobile user 160 and/or mobile computing devices 140, 200, and/or 220.

At 408, the computer system couples the toll collection server to a toll authority server. In this exemplary embodiment, computer system 100 couples toll collection server 110 to toll authority server 120.

At 409, the computer system sends an electronic payment to the toll authority server in an amount that is associated with the toll. In this exemplary embodiment, computer system 100 implements and utilizes toll collection server 110 to send an electronic payment to toll authority server 120. The toll collection server 110 has the ability to send the electronic payment to the toll authority server 120 immediately after mobile user 160 responds. Toll collection server 110 can be configured to wait a predetermined period of time before sending the electronic payment to toll authority server 120.

Figure 4B:
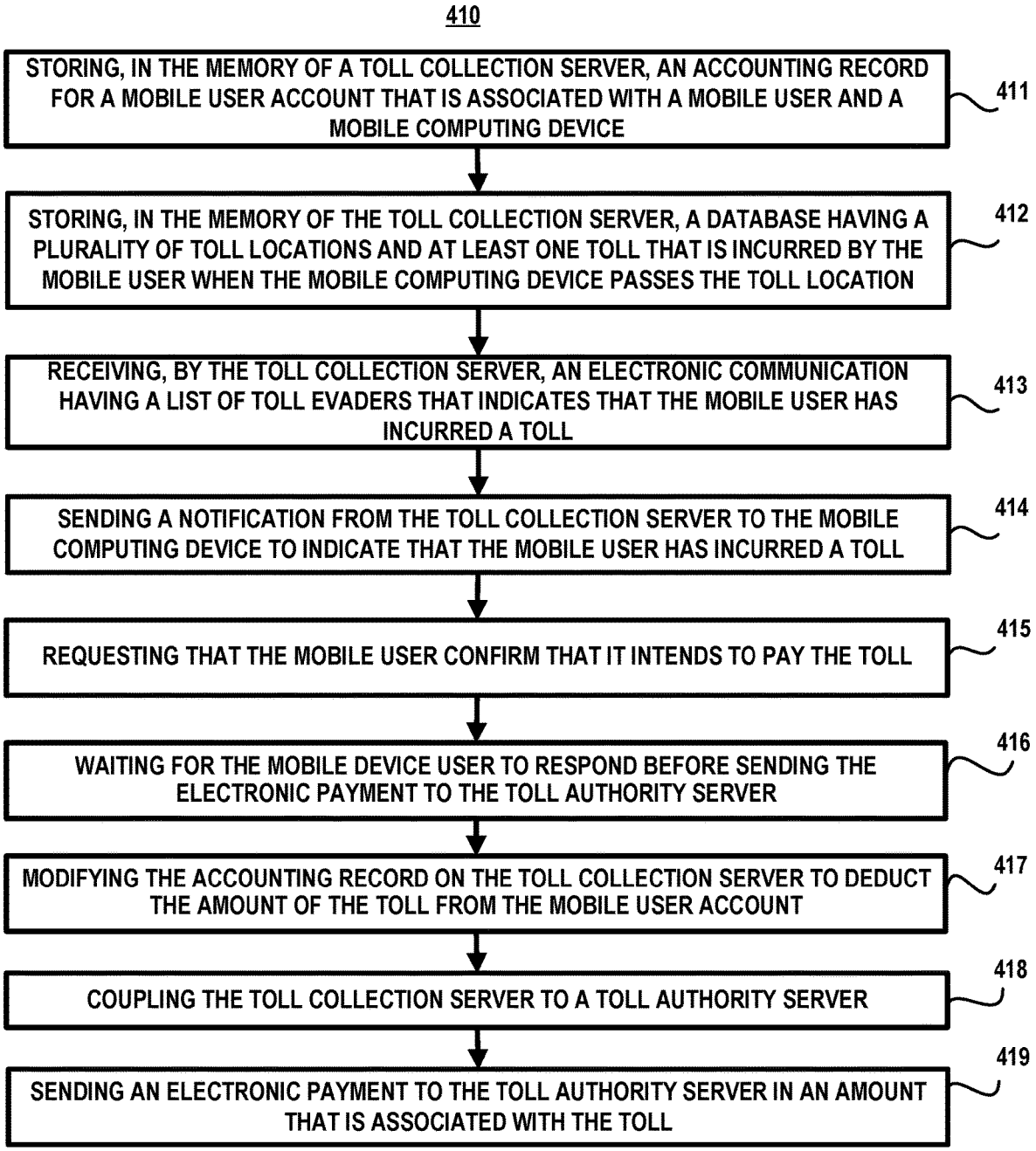
FIG. 4B illustrates an embodiment of an exemplary process in accordance with aspects of the described subject matter.

Referring to FIG. 4B with continuing reference to the foregoing figures, a computer-implemented method 410 is illustrated as an embodiment of an exemplary electronic toll collection process in accordance with aspects of the described subject matter. Computer-implemented method 410, or portions thereof, can be performed by one or more computing devices, a computer system, computer-executable instructions, software, hardware, firmware or a combination thereof in various embodiments. For example, computer-implemented method 410 can be performed by computer system 100 or other suitable computer system.

At 411, a computer system can store, in the memory of a toll collection server, an accounting record for a mobile user account that is associated with a mobile user and a mobile computing device. For example, computer system 100 can implement and utilize toll collection server 110 to store accounting record. The accounting record can include a mobile user account that is associated with mobile user 160 and/or mobile computing devices 140, 200 and/or 220.

At 412, the computer system can store, in the memory of the toll collection server, a database having a plurality of toll locations and at least one toll that is incurred by the mobile user when the mobile computing device passes the toll location. In this exemplary embodiment, computer system 100 can implement and utilize toll collection server 110 to store a database using virtual toll collection database module 114.

At 413, the computer system can receive, by the toll collection server, an electronic communication having a list of toll evaders that indicates that the mobile user has incurred a toll. In this exemplary embodiment, toll collection server 110 can receive the list of toll evaders from toll authority server 120 or from another source.

At 414, the computer system can send a notification from the toll collection server to the mobile computing device to indicate that the mobile user has incurred a toll. In this exemplary embodiment, computer system 100 can implement and utilize toll collection server 110 to send a notification to mobile computing devices 140, 200 and/or 220 that mobile user 160 has incurred a toll.

At 415, the computer system can request that the mobile user confirm that it intends to pay the toll. In this exemplary embodiment, computer system 100 can utilize application(s) 202 and/or 222 to generate a screen that requests input from mobile user 160 to confirm that he or she intends to pay the toll.

At 416, the computer system can wait for the mobile device user to respond before sending the electronic payment to the toll authority server. In this exemplary embodiment, mobile user 160 can respond using mobile computing devices 140, 200 and/or 220 to notify toll collection server 110 that he or she intends to pay the toll.

At 417, the computer system can modify the accounting record on the toll collection server to deduct the amount of the toll from the mobile user account. In this exemplary embodiment, computer system 100 utilizes accounting record processing module 112 modifies accounting record on toll collection server 110 to deduct the amount of the toll from the account of mobile user 160 that corresponds to mobile computing device 140, 200 and/or 220.

At 418, the computer system couples the toll collection server to a toll authority server. In this exemplary embodiment, computer system 100 couples toll collection server 110 to toll authority server 120.

At 419, the computer system sends an electronic payment to the toll authority server in an amount that is associated with the toll. In this exemplary embodiment, computer system 100 implements and utilizes toll collection server 110 to send an electronic payment to toll authority server 120.

Exemplary Operating Environment

Figure 5:
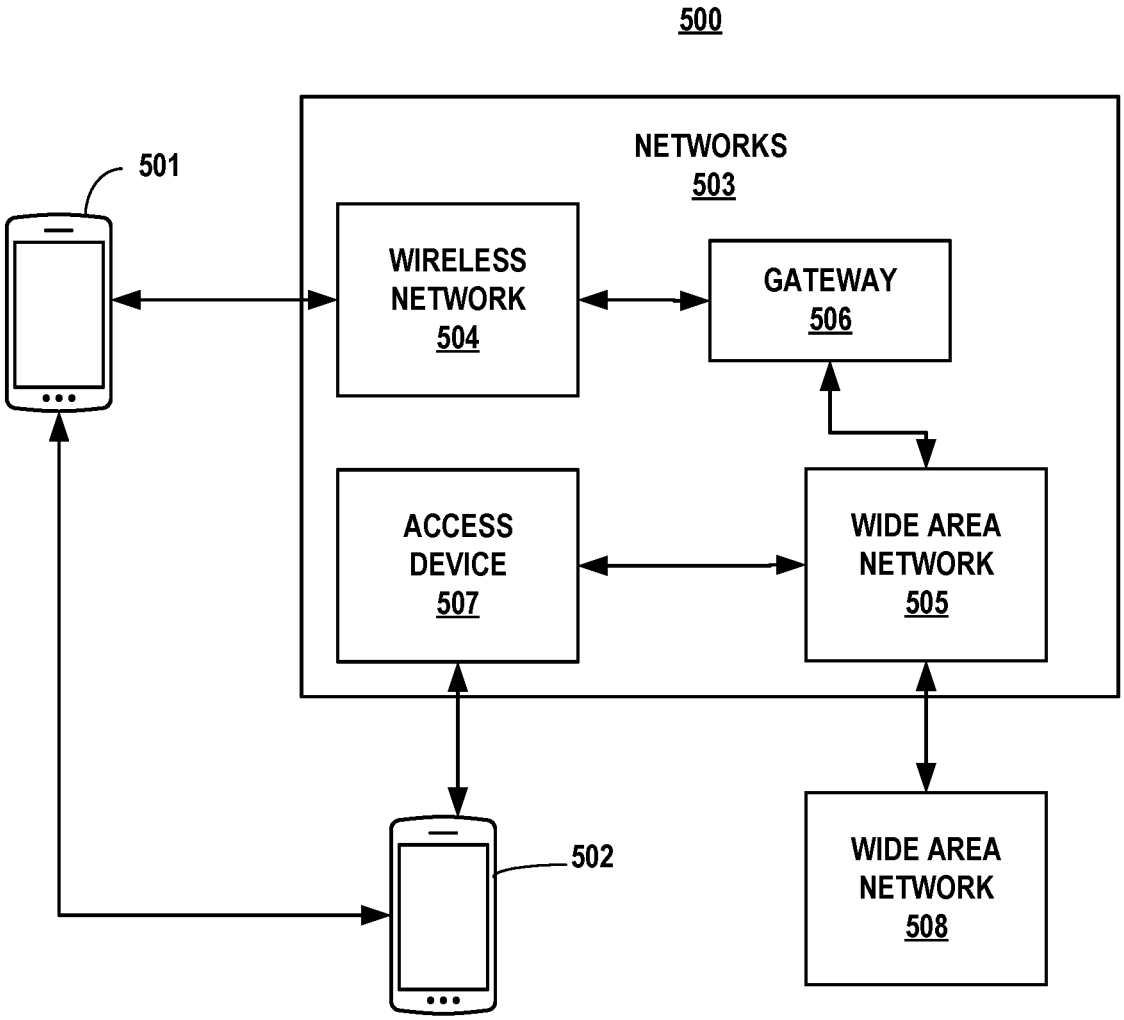
FIG. 5 illustrates an embodiment of an exemplary computing environment that can implement aspects of the described subject matter.

FIG. 5 illustrates operating environment 500 as an embodiment of an exemplary operating environment that can implement aspects of the described subject matter. It is to be appreciated that operating environment 500 can be implemented by a client-server model and/or architecture as well as by other operating environment models and/or architectures in various embodiments.

Operating environment 500 can include mobile computing devices 501 and 502, which can communicate over one or more wired or wireless networks 503. For example, wireless network 504 (e.g., a cellular network) can communicate with a wide area network (WAN) 505 (e.g., the Internet) by use of gateway 506. Likewise, access device 508 (e.g., IEEE 802.11g wireless access device) can provide communication access to WAN 505. Mobile computing devices 501 and 502 can be any device capable of displaying GUIs of the disclosed device automation application, including but not limited to navigation devices, handheld computers, portable computers, smartphones and electronic tablets.

In some implementations, both voice and data communications can be established over wireless network 504 and access device 507. For example, mobile computing device 501 can place and receive phone calls (e.g., using voice over Internet Protocol (VoIP) protocols), send and receive e-mail messages (e.g., using SMTP or Post Office Protocol 3 (POP3)), and retrieve electronic documents and/or streams, such as web pages, photographs, and videos, over wireless network 504, gateway 506, and WAN 505 (e.g., using Transmission Control Protocol/Internet Protocol (TCP/IP) or User Datagram Protocol (UDP)).

Likewise, in some implementations, mobile computing device 502 can place and receive phone calls, send and receive e-mail messages, and retrieve electronic documents over access device 507 and WAN 505. In some implementations, mobile computing devices 501 and 502 can be physically connected to access device 507 using one or more cables and access device 507 can be a personal computer. In this configuration, mobile computing device 501 or 502 can be referred to as a "tethered" device.

Mobile computing devices 501 and 502 can also establish communications by other means. For example, mobile computing device 501 can communicate with other wireless devices (e.g., mobile computing device 502) over the wireless network 504. Likewise, mobile computing devices 501 and 502 can establish peer-to-peer communications (e.g., a personal area network) by use of one or more communication subsystems, such as the BLUETOOTH communication devices. Other communication protocols and topologies can also be implemented.

Mobile computing devices 501 and 502 can communicate with server 508 over the one or more wired and/or wireless networks 503. For example, server 508 can be toll collection server 110 or toll authority server 120 shown in FIG. 1.

Mobile computing devices 501 and 502 can also access other data and content over one or more wired and/or wireless networks 503. For example, content publishers, web sites and developer networks can be accessed by mobile computing devices 501 and 502. Such access can be provided by invocation of a web browsing function or application (e.g., a browser) running on mobile computing devices 501 and 502.

Mobile computing devices 501 and 502 can exchange files over one or more wireless or wired networks 503 either directly or through server 508.

Mobile computing devices 501 and/or 502 can implement and/or perform various aspects of the described subject matter. Mobile computing devices 501 and/or 502 can include computer-executable instructions that are stored on a computer-readable storage medium and configured to implement one or more aspects of the described subject matter. By way of example, and without limitation, mobile computing devices 501 and/or 502 can implement one or more aspects of computer system 100, mobile computing device 140, mobile computing device 200, mobile computing device 220, user interface 300, user interface 320, user interface 340, user interface 360, computer-implemented method 400 and/or computer implemented method 410.

Server 508 can implement and/or perform various aspects of the described subject matter. Server 508 can include computer-executable instructions that are stored on a computer-readable storage medium and configured to implement one or more aspects of the described subject matter. By way of example, and without limitation, server 508 can implement one or more aspects of computer system 100, toll collection server 110, computer-implemented method 400 and/or computer implemented method 410.

Supported Aspects

The detailed description provided above in connection with the appended drawings explicitly describes and supports various aspects of electronic payment of tolls in accordance with the described subject matter. By way of illustration and not limitation, supported aspects of the electronic payment of tolls include a computer system for processing the electronic payment of tolls, the computer system comprising: a processor configured to execute computer-executable instructions; and memory storing computer-executable instructions configured to: store, on a toll collection server, an accounting record for a mobile user account that is associated with a mobile user and a mobile computing device; store, on the toll collection server, a database having a plurality of toll locations and at least one toll that is incurred by the mobile user when the mobile computing device passes the toll location; receive an electronic communication containing a notification that the mobile computing device passed the toll location; modify the accounting record on the toll collection server to deduct the amount of the toll from the mobile user account; couple the toll collection server to a toll authority server; and send an electronic payment to the toll authority server in an amount that is associated with the toll.

Supported aspects of the electronic payment of tolls include the forgoing computer system, wherein the mobile computing device is selected from the group consisting of a handheld device and a navigation device.

Supported aspects of the electronic payment of tolls include any of the forgoing computer systems, wherein the memory further stores computer-executable instructions configured to: determine the location of the mobile computing device with a GPS location mechanism.

Supported aspects of the electronic payment of tolls include any of the forgoing computer systems, wherein the toll authority server sends the electronic communication to the toll collection server and the electronic communication includes a list of toll evaders.

Supported aspects of the electronic payment of tolls include any of the forgoing computer systems, wherein the memory further stores computer-executable instructions configured to: send a notification from the toll collection server to the mobile computing device to indicate that the mobile user has incurred a toll; and request that the mobile user confirm that it intends to pay the toll.

Supported aspects of the electronic payment of tolls include any of the forgoing computer systems, wherein the memory further stores computer-executable instructions configured to: wait a predetermined time period for the mobile user to respond before sending the electronic payment to the toll authority server.

Supported aspects of the electronic payment of tolls include any of the forgoing computer systems, wherein the memory further stores computer-executable instructions configured to: wait for the mobile user to respond before sending the electronic payment to the toll authority server; and send the electronic payment to the toll authority server immediately after the mobile user responds.

Supported aspects of the electronic payment of tolls include any of the forgoing computer systems, wherein the memory further stores computer-executable instructions configured to: store, in the memory of the toll collection server, a plurality of virtual tollbooths with each virtual tollbooth corresponding to a toll collection location in the toll collection server database.

Supported aspects of the electronic payment of tolls include an apparatus, a computer-readable storage medium, a computer-implemented method, and/or means for implementing any of the foregoing computer systems or portions thereof.

Supported aspects of the electronic payment of tolls include a computer-implemented method for processing the electronic payment of tolls, comprising executing on a processor the steps of: storing, in the memory of a toll collection server, an accounting record for a mobile user account that is associated with a mobile user and a mobile computing device; storing, in the memory of the toll collection server, a database having a plurality of toll locations and at least one toll that is incurred by the mobile user when the mobile computing device passes the toll location; receiving, by the toll collection server, an electronic communication containing a notification that the mobile computing device passed the toll location; modifying the accounting record on the toll collection server to deduct the amount of the toll from the mobile user account; coupling the toll collection server to a toll authority server; and sending an electronic payment to the toll authority server in an amount that is associated with the toll.

Supported aspects of the electronic collection of tolls include the foregoing computer-implemented method, wherein the mobile computing device is selected from the group consisting of a handheld computer and a navigation device.

Supported aspects of the electronic collection of tolls include any of the foregoing computer-implemented methods, further comprising: determining the location of the mobile computing device with a GPS location mechanism.

Supported aspects of the electronic collection of tolls include any of the foregoing computer-implemented methods, wherein the toll authority server sends the electronic communication to the toll collection server and the electronic communication includes a list of toll evaders.

Supported aspects of the electronic collection of tolls include any of the foregoing computer-implemented methods, further comprising: sending a notification from the toll collection server to the mobile computing device to indicate that the mobile user has incurred a toll; and requesting that the mobile user confirm that it intends to pay the toll.

Supported aspects of the electronic collection of tolls include any of the foregoing computer-implemented methods, further comprising: waiting a predetermined time period for the mobile computing device user to respond before sending the electronic payment to the toll authority server.

Supported aspects of the electronic collection of tolls include any of the foregoing computer-implemented methods, further comprising: waiting for the mobile device user to respond before sending the electronic payment to the toll authority server; and sending the electronic payment to the toll authority server immediately after the mobile user responds.

Supported aspects of the electronic collection of tolls include any of the foregoing computer-implemented methods, further comprising: storing, in the memory of the toll collection server, a plurality of virtual tollbooths with each virtual tollbooth corresponding to a toll collection location in the toll collection server database.

Supported aspects of the electronic payment of tolls include a system, an apparatus, a computer-readable storage medium, and/or means for implementing and/or performing any of the foregoing computer-implemented methods or portions thereof.

Supported aspects of the electronic payment of tolls include a system for collecting electronic tolls comprising: a mobile computing device, a toll collection server connected to the mobile computing device, and a toll authority server coupled to the toll collection server, wherein the toll collection server stores an accounting record for a mobile user account that is associated with a mobile user and the mobile computing device and a database having a plurality of toll locations and at least one toll that is incurred by the mobile user when the mobile computing device passes the toll location, wherein the toll collection server has the ability to receive an electronic communication containing a notification that the mobile computing device passed the toll location, to modify the accounting record on the toll collection server to deduct the amount of the toll from the mobile user account and to send an electronic payment to the toll authority server in an amount that is associated with the toll.

Supported aspects of the electronic payment of tolls include the forgoing system, wherein the electronic communication includes a list of toll evaders.

Supported aspects of the electronic payment of tolls include any of the forgoing systems, wherein the mobile computing device includes a software application that has the ability to receive a notification from the toll collection server that indicates that the mobile user has incurred a toll and to request that the mobile user confirm that it intends to pay the toll.

Supported aspects of the electronic payment of tolls include any of the forgoing systems, wherein the toll collection server has the ability to wait for the mobile user to respond before sending the electronic payment to the toll authority server.

Supported aspects of the electronic payment of tolls include an apparatus, a computer-readable storage medium, a computer-implemented method, and/or means for implementing any of the foregoing systems or portions thereof.

Supported aspects of the electronic payment of tolls can provide various attendant and/or technical advantages in terms of improved efficiency and/or savings with respect to power consumption, memory processor cycles, and/or other computationally-expensive resources. By way of illustration and not limitation, various features and implementations of the electronic payment of tolls in accordance with the described subject matter offer many benefits to a toll agency, which include—(1) paperless invoicing, (2) up-to-date user information, (3) minimized costs of license plate look-ups, and (4) reduced resource constraints at a state motor vehicle department. Various embodiments offer many benefits to a user, which include—(1) paperless invoicing, (2) simple registration, (3) no hardware needs to be purchased, (4) no up-front costs, (5) a nationwide one-stop payment process, and (6) reduced need to visit to the state motor vehicle department to buy hardware or register.

The detailed description provided above in connection with the appended drawings is intended as a description of examples and is not intended to represent the only forms in which the present examples can be constructed or utilized.

It is to be understood that the configurations and/or approaches described herein are exemplary in nature, and that the described embodiments, implementations and/or examples are not to be considered in a limiting sense, because numerous variations are possible. The specific processes or methods described herein can represent one or more of any number of processing strategies. As such, various operations illustrated and/or described can be performed in the sequence illustrated and/or described, in other sequences, in parallel, or omitted. Likewise, the order of the above-described processes can be changed. For example, it should be understood that geofencing technology that can be implemented in computer system 100, mobile computing device 200, mobile computing device 220, user interface 300, user interface 320, user interface 340, user interface 360, computer-implemented method 400, computer implemented method 410 and/or operating environment 500 can be used in mass transit applications, such as busses and trains, and in parking applications.

Although the subject matter has been described in language specific to structural features and/or methodological acts, it is to be understood that the subject matter defined in the appended claims is not necessarily limited to the specific features or acts described above. Rather, the specific features and acts described above are presented as example forms of implementing the claims.

What is claimed is:

1. A computer system for processing the electronic payment of tolls, the computer system comprising:

a processor configured to execute computer-executable instructions; and memory storing computer-executable instructions configured to:

store, on a toll collection server, an accounting record for a mobile user account that is associated with a mobile user and a mobile computing device;

store, on the toll collection server, a database having a plurality of toll locations, respective geofences associated with the plurality of toll locations, and at least one toll that is incurred by the mobile user when the mobile computing device passes at least one toll location of the plurality of toll locations;

increase a frequency of GPS position measurements, on the toll collection server, when the mobile computing device has entered the respective geofence of the at least one toll location to trace the path of the mobile computing device;

decrease the frequency of the GPS position measurements, on the toll collection server, when the mobile computing device has exited the respective geofence of the at least one toll location to reduce use of a battery in the mobile computing device;

send a first notification from the toll collection server to the mobile computing device to indicate the mobile computing device is within the geofence of the at least one toll location;

receive an electronic communication containing a second notification that the mobile computing device has exited the respective geofence of the at least one toll location;

modify the accounting record on the toll collection server to deduct the amount of the toll from the mobile user account;

couple the toll collection server to a toll authority server; and send an electronic payment to the toll authority server in an amount that is associated with the toll for the at least one toll location.

2. The computer system of claim 1, wherein the mobile computing device is selected from the group consisting of a handheld device and a navigation device.

3. The computer system of claim 1, wherein the toll authority server sends the electronic communication to the toll collection server and the electronic communication includes a list of toll evaders.

4. The computer system as set forth in claim 1, wherein the memory further stores computer-executable instructions configured to:

send a notification from the toll collection server to the mobile computing device to indicate that the mobile user has incurred a toll; and request that the mobile user confirm that it intends to pay the toll.

5. The computer system as set forth in claim 4, wherein the memory further stores computer-executable instructions configured to: wait a predetermined time period for the mobile user to respond before sending the electronic payment to the toll authority server.

6. The computer system as set forth in claim 4, wherein the memory further stores computer-executable instructions configured to:

wait for the mobile user to respond before sending the electronic payment to the toll authority server; and send the electronic payment to the toll authority server immediately after the mobile user responds.

7. The computer system as set forth in claim 1, wherein the memory further stores computer-executable instructions configured to:

store, in the memory of the toll collection server, a plurality of virtual tollbooths with each virtual tollbooth corresponding to a toll collection location in the toll collection server database.

8. A computer-implemented method for processing the electronic payment of tolls, comprising executing on a processor the steps of:

storing, in the memory of a toll collection server, an accounting record for a mobile user account that is associated with a mobile user and a mobile computing device including a battery;

storing, in the memory of the toll collection server, a database having a plurality of toll locations, respective geofences associated with the plurality of toll locations, and at least one toll that is incurred by the mobile user when the mobile computing device passes at least one toll location of the plurality of toll locations;

increasing a frequency of GPS position measurements, on the toll collection server, when the mobile computing device has entered the respective geofence of the at least one toll location to trace the path of the mobile computing device;

decreasing the frequency of the GPS position measurements, on the toll collection server, when the mobile computing device has exited the respective geofence of the at least one toll location to reduce use of the mobile computing device battery;

sending a first notification from the toll collection server to the mobile computing device to indicate the mobile computing device is within the geofence of the at least one toll location;

receiving, by the toll collection server, an electronic communication containing a second notification that the mobile computing device has exited the respective geofence of the at least one toll location;

modifying the accounting record on the toll collection server to deduct the amount of the toll from the mobile user account;

coupling the toll collection server to a toll authority server; and sending an electronic payment to the toll authority server in an amount that is associated with the toll for the at least one toll location.

9. The computer-implemented method of claim 8, wherein the mobile computing device is selected from the group consisting of a handheld computer and a navigation device.

10. The method of claim 8, further comprising:

determining a direction of travel of the mobile computing device based on an entry point at the respective geofence and an exit point at the respective geofence.

11. The computer-implemented method of claim 8, wherein the toll authority server sends the electronic communication to the toll collection server and the electronic communication includes a list of toll evaders.

12. The computer-implemented method of claim 8, further comprising:

sending a notification from the toll collection server to the mobile computing device to indicate that the mobile user has incurred a toll; and requesting that the mobile user confirm that it intends to pay the toll.

13. The computer-implemented method of claim 12, further comprising:

waiting a predetermined time period for the mobile computing device user to respond before sending the electronic payment to the toll authority server.

14. The computer-implemented method of claim 12, further comprising:

waiting for the mobile device user to respond before sending the electronic payment to the toll authority server; and sending the electronic payment to the toll authority server immediately after the mobile user responds.

15. The computer-implemented method of claim 8, further comprising:

storing, in the memory of the toll collection server, a plurality of virtual tollbooths with each virtual tollbooth corresponding to a toll collection location in the toll collection server database.

16. A system for collecting electronic tolls comprising:

a mobile computing device including a battery;

a toll collection server connected to the mobile computing device; and a toll authority server coupled to the toll collection server;

wherein the toll collection server stores:

an accounting record for a mobile user account that is associated with a mobile user and the mobile computing device, and a database having a plurality of toll locations, respective geofences associated with the plurality of toll locations, and at least one toll that is incurred by the mobile user when the mobile computing device passes at least one toll location of the plurality of toll locations, and wherein the toll collection server has the ability to:

increase a frequency of GPS position measurements, on the toll collection server, when the mobile computing device has entered the respective geofence of the at least one toll location to trace the path of the mobile computing device;

decrease the frequency of the GPS position measurements, on the toll collection server, when the mobile computing device has exited the respective geofence of the at least one toll location to reduce use of the mobile computing device battery;

send a first notification to the mobile computing device to indicate the mobile computing device is within the geofence of the at least one toll location;

send, to the mobile computing device, an electronic communication containing a second notification that the mobile computing device has exited the respective geofence of the at least one toll location;

modify the accounting record on the toll collection server to deduct the amount of the toll from the mobile user account; and send an electronic payment to the toll authority server in an amount that is associated with the toll for the at least one toll location.

17. The system of claim 16, wherein the electronic communication includes a list of toll evaders.

18. The system of claim 16, wherein the mobile computing device includes a software application that has the ability to receive a notification from the toll collection server that indicates that the mobile user has incurred a toll and to request that the mobile user confirm that it intends to pay the toll.

19. The system of claim 18, wherein the toll collection server has the ability to wait for the mobile user to respond before sending the electronic payment to the toll authority server.

20. The system of claim 18, wherein the toll collection server is further configured to:

determine a direction of travel of the mobile computing device based on an entry point at the respective geofence and an exit point at the respective geofence.

* * * * *